US010195868B2

(12) United States Patent
Yamada et al.

(10) Patent No.: US 10,195,868 B2
(45) Date of Patent: Feb. 5, 2019

(54) LIQUID EJECTING APPARATUS AND LIQUID EJECTING HEAD

(71) Applicant: CANON KABUSHIKI KAISHA, Tokyo (JP)

(72) Inventors: Kazuhiro Yamada, Yokohama (JP); Shuzo Iwanaga, Kawasaki (JP); Seiichiro Karita, Saitama (JP); Shingo Okushima, Kawasaki (JP); Zentaro Tamenaga, Sagamihara (JP); Noriyasu Nagai, Tokyo (JP); Tatsurou Mori, Yokohama (JP); Akio Saito, Machida (JP); Takatsuna Aoki, Yokohama (JP); Akira Yamamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/583,222

(22) Filed: May 1, 2017

(65) Prior Publication Data

US 2017/0341406 A1 Nov. 30, 2017

(30) Foreign Application Priority Data

May 25, 2016 (JP) ..... 2016-104309

(51) Int. Cl.

| | |
|---|---|
| ***B41J 2/175*** | (2006.01) |
| ***B41J 2/19*** | (2006.01) |
| ***B41J 2/18*** | (2006.01) |

(52) U.S. Cl.

CPC ..... *B41J 2/17596* (2013.01); *B41J 2/175* (2013.01); *B41J 2/18* (2013.01); *B41J 2/19* (2013.01)

(58) Field of Classification Search

CPC ..... B41J 2/17596; B41J 2/19

See application file for complete search history.

(56) References Cited

U.S. PATENT DOCUMENTS

| | | | |
|---|---|---|---|
| 4,737,801 A | 4/1988 | Ichihashi et al. | 347/85 |
| 4,748,459 A | 5/1988 | Ichihashi et al. | 347/31 |

(Continued)

FOREIGN PATENT DOCUMENTS

| | | |
|---|---|---|
| JP | 3606282 | 1/2005 |
| WO | WO 03/041964 | 5/2003 |

OTHER PUBLICATIONS

U.S. Appl. No. 15/382,027, filed Dec. 16, 2016.

(Continued)

*Primary Examiner* — Shelby L Fidler
(74) *Attorney, Agent, or Firm* — Venable LLC

(57) ABSTRACT

A liquid ejecting apparatus has a liquid ejecting unit and a negative pressure regulating unit provided between passages connecting the tank to the liquid ejecting unit, regulates fluid pressure of liquid flowing into the liquid ejecting unit. The negative pressure regulating unit includes a negative pressure chamber whose internal pressure is regulated within a predetermined range, and a discharging passage for discharging liquid stored in the negative pressure chamber from the negative pressure regulating unit. The discharging passage has an outlet disposed in an upper portion of the negative pressure chamber in a direction of gravity, a bubble accumulation portion connected to the outlet and having a space above the outlet in the direction of gravity, and a passage guiding liquid flowing from the outlet to a discharging port opened in a bottom of the negative pressure regulating unit.

18 Claims, 15 Drawing Sheets

(56) References Cited

U.S. PATENT DOCUMENTS

| | | | | |
|---|---|---|---|---|
| 4,896,172 | A | 1/1990 | Nozawa et al. | 347/17 |
| 4,908,636 | A | 3/1990 | Saito et al. | 347/25 |
| 5,051,759 | A | 9/1991 | Karita et al. | 347/87 |
| 5,155,502 | A | 10/1992 | Kimura et al. | 347/87 |
| 5,166,707 | A | 11/1992 | Watanabe et al. | 347/3 |
| 5,189,443 | A | 2/1993 | Arashima et al. | 347/63 |
| 5,216,446 | A | 6/1993 | Satoi et al. | 347/65 |
| 5,237,342 | A | 8/1993 | Saikawa et al. | 347/87 |
| 5,251,040 | A | 10/1993 | Saito | 358/296 |
| 5,280,299 | A | 1/1994 | Saikawa et al. | 347/87 |
| 5,291,215 | A | 3/1994 | Nozawa et al. | 347/18 |
| 5,329,304 | A | 7/1994 | Koizumi et al. | 347/7 |
| 5,471,230 | A | 11/1995 | Saito et al. | 347/29 |
| 5,481,283 | A | 1/1996 | Watanabe et al. | 347/33 |
| 5,481,290 | A | 1/1996 | Watanabe et al. | 347/104 |
| 5,483,267 | A | 1/1996 | Nemura et al. | 347/32 |
| 5,488,395 | A | 1/1996 | Takayanagi et al. | 347/7 |
| 5,500,666 | A | 3/1996 | Hattori et al. | 347/87 |
| 5,502,479 | A | 3/1996 | Ishinaga et al. | 347/93 |
| 5,515,091 | A | 5/1996 | Kimura et al. | 347/86 |
| 5,548,309 | A | 8/1996 | Okubo et al. | 347/33 |
| 5,559,536 | A | 9/1996 | Saito et al. | 347/25 |
| 5,619,238 | A | 4/1997 | Higuma et al. | 347/86 |
| 5,623,287 | A | 4/1997 | Saikawa et al. | 347/47 |
| 5,629,728 | A | 5/1997 | Karita et al. | 347/87 |
| 5,689,290 | A | 11/1997 | Saito et al. | 347/7 |
| 5,703,632 | A | 12/1997 | Arashima et al. | 347/47 |
| 5,757,399 | A | 5/1998 | Murayama et al. | 347/32 |
| 5,864,352 | A | 1/1999 | Aoki et al. | 347/102 |
| 5,917,514 | A | 6/1999 | Higuma et al. | 347/29 |
| 5,917,524 | A | 6/1999 | Kimura et al. | 347/86 |
| 6,012,795 | A | 1/2000 | Saito et al. | 347/7 |
| 6,048,045 | A | 4/2000 | Nohata et al. | 347/7 |
| 6,056,386 | A | 5/2000 | Nohata et al. | 347/19 |
| 6,123,420 | A | 9/2000 | Higuma et al. | 347/86 |
| 6,247,784 | B1 | 6/2001 | Obana et al. | 347/37 |
| 6,250,752 | B1 | 6/2001 | Tajima et al. | 347/92 |
| 6,286,945 | B1 | 9/2001 | Higuma et al. | 347/86 |
| 6,290,344 | B1 | 9/2001 | Saikawa et al. | 347/86 |
| 6,332,673 | B1 | 12/2001 | Higuma et al. | 347/86 |
| 6,382,786 | B2 | 5/2002 | Iwanaga et al. | 347/86 |
| 6,406,118 | B1 | 6/2002 | Aoki et al. | 347/16 |
| 6,419,341 | B1 | 7/2002 | Nohata et al. | 347/19 |
| 6,419,349 | B1 | 7/2002 | Iwanaga et al. | 347/86 |
| 6,474,801 | B2 | 11/2002 | Higuma et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,688,735 | B2 | 2/2004 | Higuma et al. | 347/86 |
| 6,742,881 | B2 | 6/2004 | Kotaki et al. | 347/86 |
| 6,796,643 | B2 | 9/2004 | Higuma et al. | 347/85 |
| 7,156,507 | B2 | 1/2007 | Aruga et al. | 347/85 |
| 9,315,041 | B2 | 4/2016 | Moriguchi et al. | B41J 2/18 |
| 9,327,513 | B2 | 5/2016 | Moriguchi et al. | B41J 2/175 |
| 9,358,803 | B2 | 6/2016 | Moriguchi et al. | B41J 2/175 |
| 2002/0113853 | A1 | 8/2002 | Hattori et al. | 347/86 |
| 2003/0043241 | A1 | 3/2003 | Hattori et al. | 347/86 |
| 2005/0073559 | A1* | 4/2005 | Aruga | B41J 2/17509 347/85 |
| 2005/0151804 | A1* | 7/2005 | Hayashi | B41J 2/175 347/85 |
| 2010/0053284 | A1* | 3/2010 | Miyajima | B41J 2/14233 347/92 |
| 2011/0228020 | A1* | 9/2011 | Nishimori | B41J 2/17563 347/92 |
| 2012/0050358 | A1* | 3/2012 | Kitabatake | B41J 2/17509 347/6 |
| 2012/0050424 | A1* | 3/2012 | Nabeshima | B41J 2/175 347/92 |
| 2013/0169710 | A1* | 7/2013 | Keefe | B41J 2/175 347/17 |
| 2013/0233939 | A1* | 9/2013 | Uezawa | B41J 2/14274 239/102.1 |
| 2016/0144628 | A1* | 5/2016 | Sato | B41J 2/17596 347/85 |

OTHER PUBLICATIONS

U.S. Appl. No. 15/387,340, filed Dec. 21, 2016.
U.S. Appl. No. 15/387,334, filed Dec. 21, 2016.
U.S. Appl. No. 15/382,039, filed Dec. 16, 2016.
U.S. Appl. No. 15/382,048, filed Dec. 16, 2016.
U.S. Appl. No. 15/380,584, filed Dec. 15, 2016.

* cited by examiner

LIQUID EJECTING APPARATUS AND LIQUID EJECTING HEAD

BACKGROUND OF THE INVENTION

Field of the Invention

The present invention relates to a liquid ejecting apparatus and a liquid ejecting head.

Description of the Related Art

In order to maintain normal ejecting operation in a liquid ejecting head, it is required that a suitable meniscus be stably formed near an ejection port that communicates with air. The shape of the meniscus is determined depending on a balance between capillary action that directs liquid toward the ejection port and negative pressure that acts on the liquid to return the liquid in the opposite direction. Thus, a mechanism that continuously generates suitable negative pressure suitable for the capillary action irrespective of ejection frequency and ink consumption is required in the liquid ejecting head.

For example, in a relatively small liquid ejecting apparatus in which a liquid ejecting head and a tank supplying liquid to the liquid ejecting head are integrated with each other, it is possible to generate the negative pressure within a substantially suitable range by providing a negative pressure generation member such as a sponge impregnated with liquid in the tank. However, in the mode of supplying liquid to a liquid ejecting head through a tube or the like from a large-capacity tank fixed in an apparatus, a considerable influence of a pressure loss makes it difficult to maintain the negative pressure within a suitable range.

As a means to solve the above problem, Japanese Patent No. 3606282 discloses a configuration comprising a valve unit (regulator) immediately in front of a liquid ejecting head to maintain the negative pressure within a suitable range.

SUMMARY OF THE INVENTION

According to a first aspect of the present invention, there is provided a liquid ejecting apparatus comprising: a liquid ejecting unit configured to eject liquid supplied from a tank; and a negative pressure regulating unit, being provided between passages connecting the tank to the liquid ejecting unit, configured to regulate fluid pressure of liquid flowing into the liquid ejecting unit, wherein the negative pressure regulating unit includes a negative pressure chamber whose internal pressure is regulated within a predetermined range, and a discharging passage for discharging liquid stored in the negative pressure chamber from the negative pressure regulating unit, and the discharging passage has an outlet disposed in an upper portion of the negative pressure chamber in a direction of gravity, a bubble accumulation portion connected to the outlet and having a space above the outlet in the direction of gravity, and a passage guiding liquid flowing from the outlet to a discharging port opened in a bottom of the negative pressure regulating unit.

According to a second aspect of the present invention, there is provided a liquid ejecting head comprising: a negative pressure regulating unit configured to regulate fluid pressure of liquid supplied from a tank; and a liquid ejecting unit, being connected to the negative pressure regulating unit, configured to eject liquid whose fluid pressure has been regulated, wherein the negative pressure regulating unit includes a negative pressure chamber whose internal pressure is regulated within a predetermined range, and a discharging passage for discharging liquid stored in the negative pressure chamber from the negative pressure regulating unit, and the discharging passage has an outlet disposed in an upper portion of the negative pressure chamber in a direction of gravity, a bubble accumulation portion connected to the outlet and having a space above the outlet in the direction of gravity, and a passage guiding liquid flowing from the outlet to a discharging port opened in a bottom of the negative pressure regulating unit.

Further features of the present invention will become apparent from the following description of exemplary embodiments with reference to the attached drawings.

DESCRIPTION OF THE EMBODIMENTS

The configuration disclosed in Japanese Patent No. 3606282 is directed mainly to a serial type liquid ejecting apparatus. For this reason, in a case where the flow rate of liquid to be supplied to a head is large as in a full line type liquid ejecting apparatus, it is desirable that the cross-sectional area of a passage of a valve unit is increased to reduce the flow resistance. In this case, however, bubbles often remain in the valve unit, which interferes with the pressure control. In other words, in a case where the flow rate of liquid is large, it is difficult to continuously maintain negative pressure suitable for the liquid ejecting head even by the adoption of the configuration disclosed in Japanese Patent No. 3606282.

The present invention has been accomplished in order to solve the above problem. Therefore, the object of the present invention is to provide a liquid ejecting apparatus and a liquid ejecting head capable of suitably controlling negative pressure to maintain stable ejecting operation even in the mode of a relatively large flow rate.

(Description of Inkjet Printing Apparatus)

Figure 1:
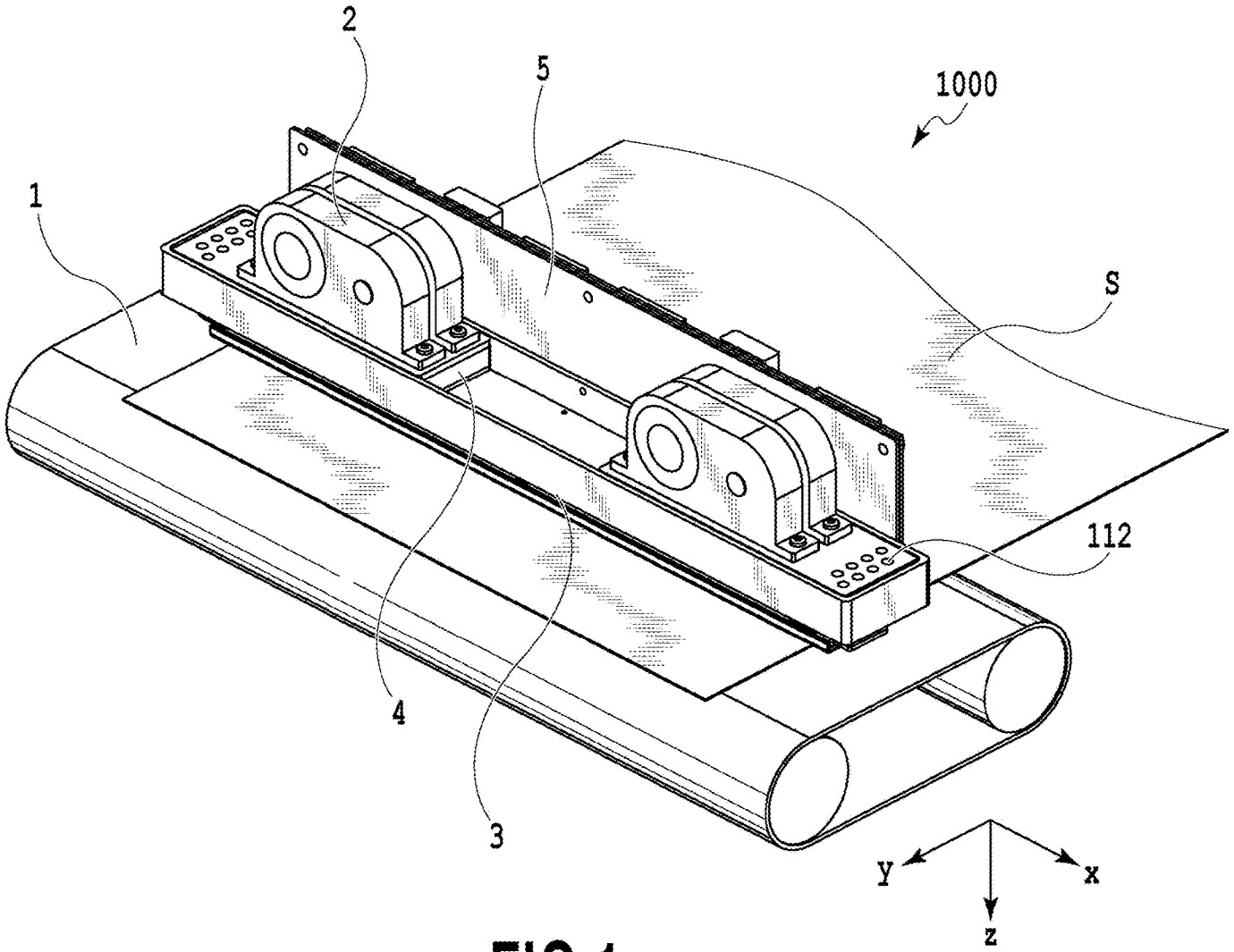
FIG. 1 is a schematic view of the inner configuration of an inkjet printing apparatus.

FIG. 1 is a schematic view of the inner configuration of an inkjet printing apparatus 1000 which can be used as a liquid ejecting apparatus of the present invention. A conveying unit 1 conveys a sheet S that serves as a print medium at a constant speed in a y direction. A liquid ejecting head 3 ejects ink in a z direction toward the sheet S being conveyed in accordance with print data. The liquid ejecting head 3 of the present embodiment is a full line type inkjet printing head including a plurality of nozzles that eject ink of the same color (the same type of liquid) and are arrayed in an x direction over a distance corresponding to the width of the sheet S. Such an array of nozzles is provided for each ink color, namely, each of cyan, magenta, yellow, and black, and these arrays are disposed in parallel in the y direction. Data and power necessary for ejecting operation are supplied from an electric wiring unit 5. The sheet S may be a cut sheet or a roll of paper.

A liquid supply unit 4 for receiving ink from a tube (not shown) and supplying the ink to the liquid ejecting head 3 is provided above the liquid ejecting head 3 in the direction of gravity (i.e., a −z direction). A negative pressure control unit 2 for pressure control of ink supplied to the liquid ejecting head 3 is further provided above the liquid supply unit 4. The liquid supply unit 4 and the negative pressure control unit 2 are provided for each ink color such that negative pressure in the liquid ejecting head 3 is independently controlled for each ink color.

Figure 2:
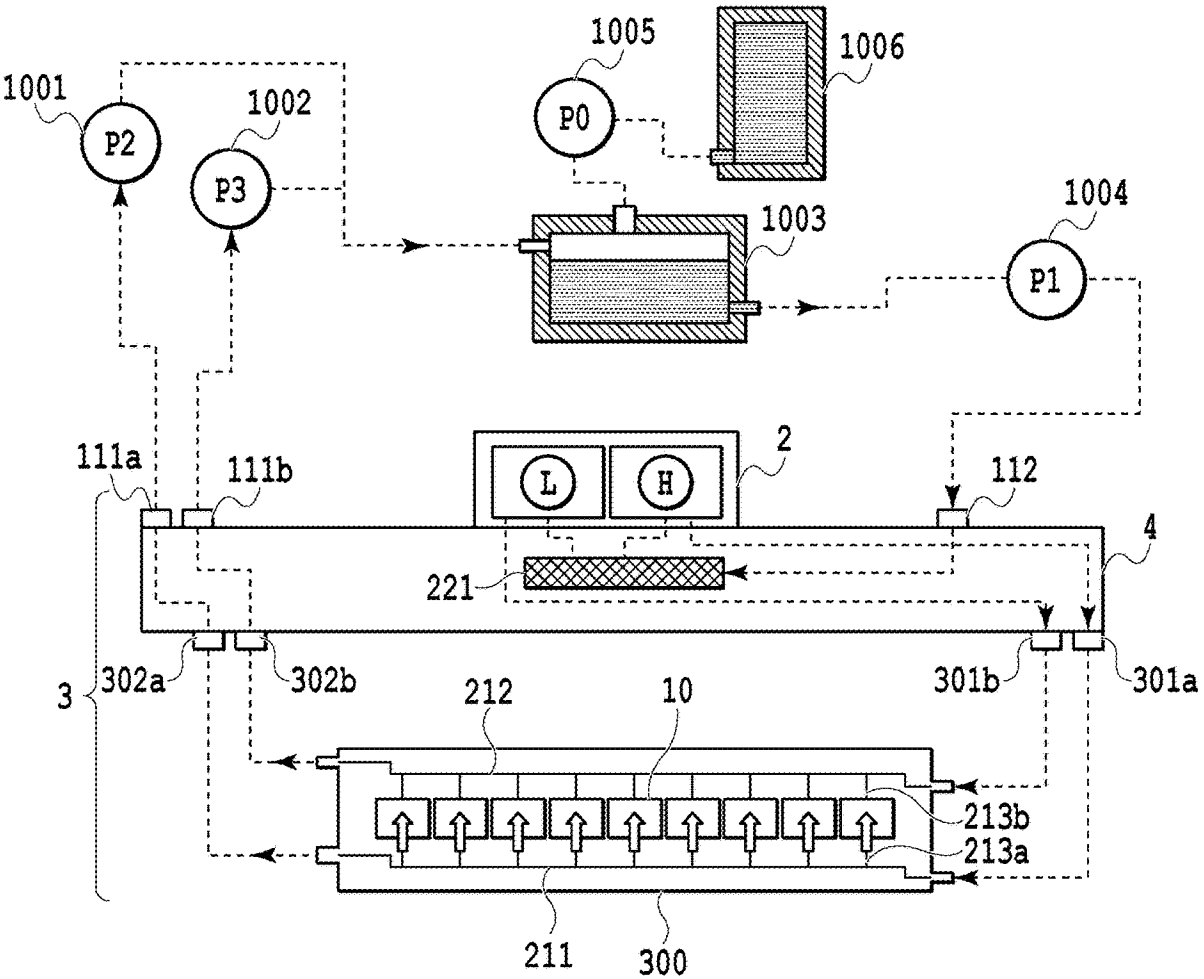
FIG. 2 is a diagram showing liquid circulation passages in the inkjet printing apparatus.

FIG. 2 is a diagram showing liquid circulation passages in the inkjet printing apparatus 1000. In the figure, circulation passages for one ink color are shown. A buffer tank 1003 is connected to a first high-pressure circulation pump 1001, a first low-pressure circulation pump 1002, and a second circulation pump 1004. The operation of these pumps causes ink to flow from left to right in the figure. In a case where the amount of ink remaining in the buffer tank 1003 decreases, a refill pump 1005 operates to refill the buffer tank 1003 with ink from a large-capacity main tank 1006 fixed in the apparatus. The buffer tank 1003 is equipped with an air communication port through which bubbles flowing there can be discharged from the liquid circulation passages.

The first high-pressure circulation pump 1001 and the first low-pressure circulation pump 1002 guide ink flowing from the liquid supply unit 4 to the buffer tank 1003 through outlet connection portions 111*a* and 111*b*.

The second circulation pump 1004 supplies ink stored in the buffer tank 1003 to the liquid supply unit 4 through an inlet connection portion 112. The installation of the second circulation pump 1004 makes it possible to maintain fluid pressure in the liquid ejecting head 3 within a certain range even if the amount of ink remaining in the buffer tank 1003 sharply decreases due to high-density printing or recovery processing of the liquid ejecting head 3. In other words, the buffer tank 1003 can be laid out in the apparatus without the need to consider the remaining amount of ink and a pressure head.

The liquid supply unit 4 removes foreign matters from ink supplied from the inlet connection portion 112 with a filter 221, and then supplies the ink to the negative pressure control unit 2. In the negative pressure control unit 2, a negative pressure control unit H that allows ink to flow at a high fluid pressure and a negative pressure control unit L that allows ink to flow at a low fluid pressure are disposed in parallel. The ink flowing from the negative pressure control unit H and the ink flowing from the negative pressure control unit L are supplied to a liquid ejecting unit 300 in the liquid ejecting head 3 through an inlet port 301*a* and an inlet port 301*b*, respectively.

The liquid ejecting unit 300 is equipped with a common supply passage 211 through which ink flows at a high pressure due to the first high-pressure circulation pump 1001 and the negative pressure control unit H, and a common collection passage 212 through which ink flows at a low pressure due to the first low-pressure circulation pump 1002 and the negative pressure control unit L. Further, in the liquid ejecting unit 300, printing element substrates 10, each having a plurality of nozzles arrayed in the x direction, are connected in the x direction. Each printing element substrate 10 is equipped with an individual supply passage 213*a* connected to the common supply passage 211 and an individual collection passage 213*b* connected to the common collection passage 212. Accordingly, in each printing element substrate 10, an ink flow is caused according to a difference in fluid pressure between the common supply passage 211 and the common collection passage 212. More specifically, ink flows from the common supply passage 211 having high pressure through the individual supply passage 213*a*, and then flows into the common collection passage 212 through the individual collection passage 213*b*.

At this time, if ejecting operation is carried out in each printing element substrate 10, part of the circulating ink is consumed by the ejection and the rest of the ink flows through the individual collection passage 213*b* and the common collection passage 212 and then is discharged to the liquid supply unit 4 through an outlet port 302*b*. On the other hand, ink that has not flowed into any of the individual supply passages 213*a* in the common supply passage 211 is discharged to the liquid supply unit through an outlet port 302*a*. The ink flowing into the liquid supply unit 4 through the outlet ports 302*a* and 302*b* is supplied to the first high-pressure circulation pump 1001 and the first low-pressure circulation pump 1002 through outlet connection portions 111*a* and 111*b*.

In the liquid ejecting head using the above-described circulation supply circuit, heat generated by the ejecting operation of the printing element substrates 10 is dissipated by the flowing liquid. As a result, it is possible to prevent an ejection failure caused by heat accumulation even if the ejecting operation is continuously carried out. In addition, thickened ink and foreign matters are less prone to stay near nozzles having low ejection frequency. Therefore, the ejection state of all the nozzles can be stabilized.

However, if the flow rate is increased too much for the purpose of obtaining the above effect, a pressure loss in the liquid ejecting unit 300 may cause a pressure difference between the printing element substrates 10, which may lead to variations in the ejection state and uneven density. For this reason, in the first high-pressure circulation pump 1001 and the first low-pressure circulation pump 1002 used in the present embodiment, it is desirable that the discharge flow rate is regulated such that a printed image is not affected by differences in temperature and pressure between the printing element substrates 10. For instance, positive displacement pumps having quantitative liquid delivery ability such as tube pumps, gear pumps, diaphragm pumps, and syringe pumps are desirable. Alternatively, a general constant flow valve or a general relief valve may be disposed at an outlet of a pump to ensure a predetermined flow rate.

On the other hand, as the second circulation pump 1004, a turbo pump or a positive displacement pump may be used as long as a predetermined head pressure or more can be exhibited in the range of the ink circulation flow rate used at the time of driving. For example, a diaphragm pump may be used. Alternatively, for example, a water head tank disposed to have a certain water head difference with respect to the negative pressure regulating unit may be used instead of the second circulation pump.

Figure 3A:
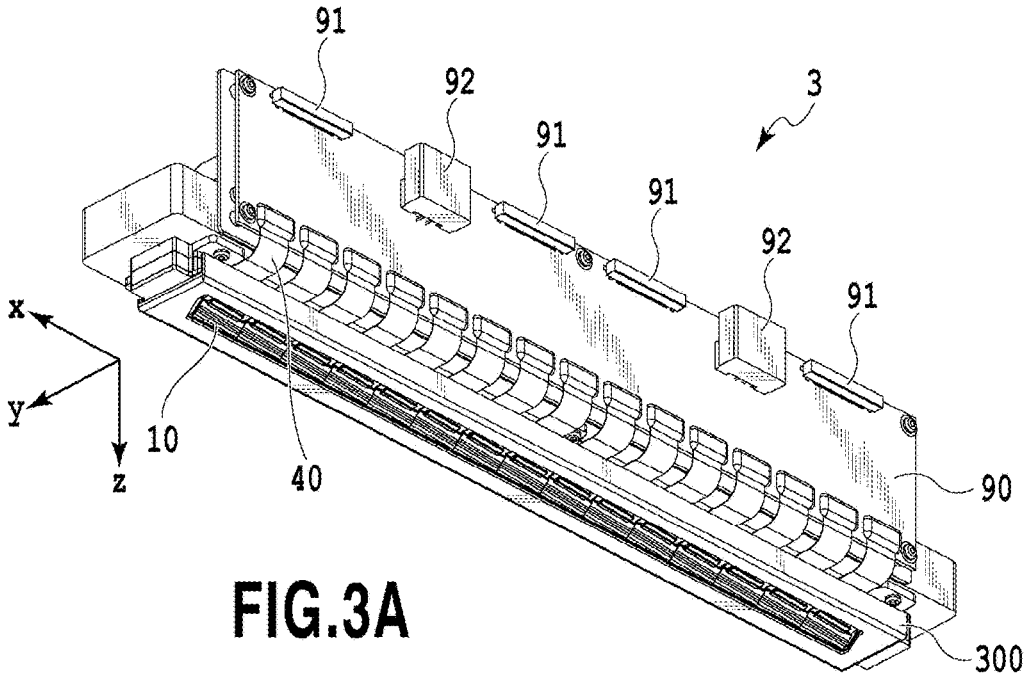
FIGS. 3A and 3B are external perspective views of a liquid ejecting head.
Figure 3B:
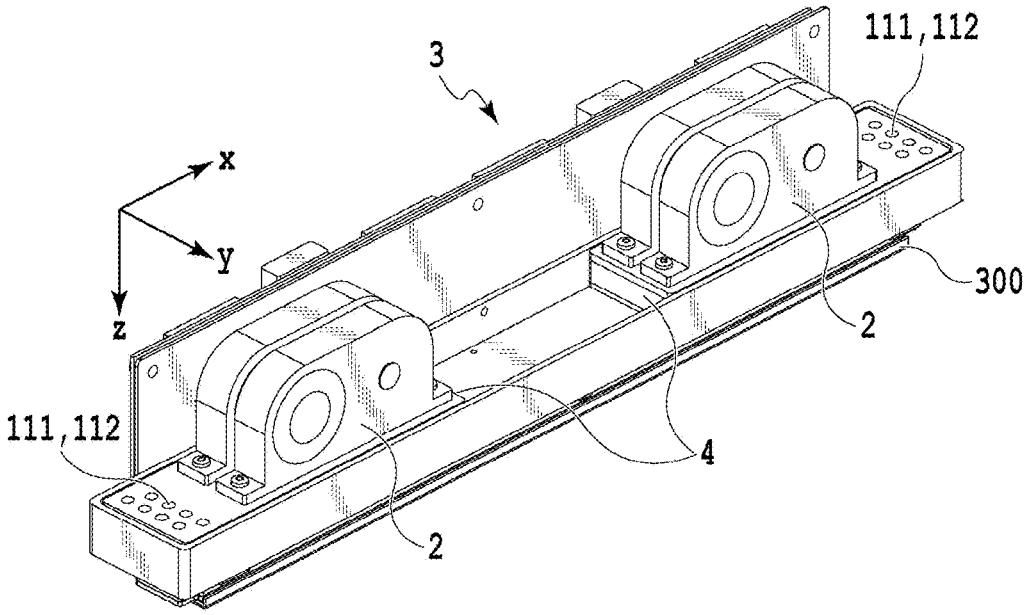

FIGS. 3A and 3B are external perspective views of the liquid ejecting head 3. The liquid ejecting head 3 of the present embodiment is a full line type color inkjet printing head that covers the entire width of the sheet S. Fifteen printing element substrates 10 are arrayed in the x direction. Each printing element substrate 10 ejects ink of four colors, namely, cyan, magenta, yellow, and black, in the z direction in accordance with ejection data.

The ejection data and power necessary for the ejecting operation is supplied to signal input terminals 91 and power supply terminals 92 provided in an electric wiring board 90, and supplied to the printing element substrates 10 through flexible wiring substrates 40, respectively. In the present embodiment, the numbers of signal input terminals 91 and power supply terminals 92 are less than the number (i.e., 15) of printing element substrates 10.

As described above with reference to FIG. 2, ink ejected from the printing element substrates 10 flows into the liquid supply unit 4 through the inlet connection portion 112, is subjected to a fluid pressure regulate in the negative pressure control unit 2, and is then supplied to the liquid ejecting unit 300. Ink that has not been consumed by the ejection is discharged again from the liquid ejecting head 3 through the outlet connection portions 111. In the figure, the inlet connection portions 112 for four ink colors and the outlet connection portion 111 used for discharging are shown. Tubes for communicating with the pumps are connected to the inlet connection portions 112 and the outlet connection portions 111, respectively.

Figure 4:
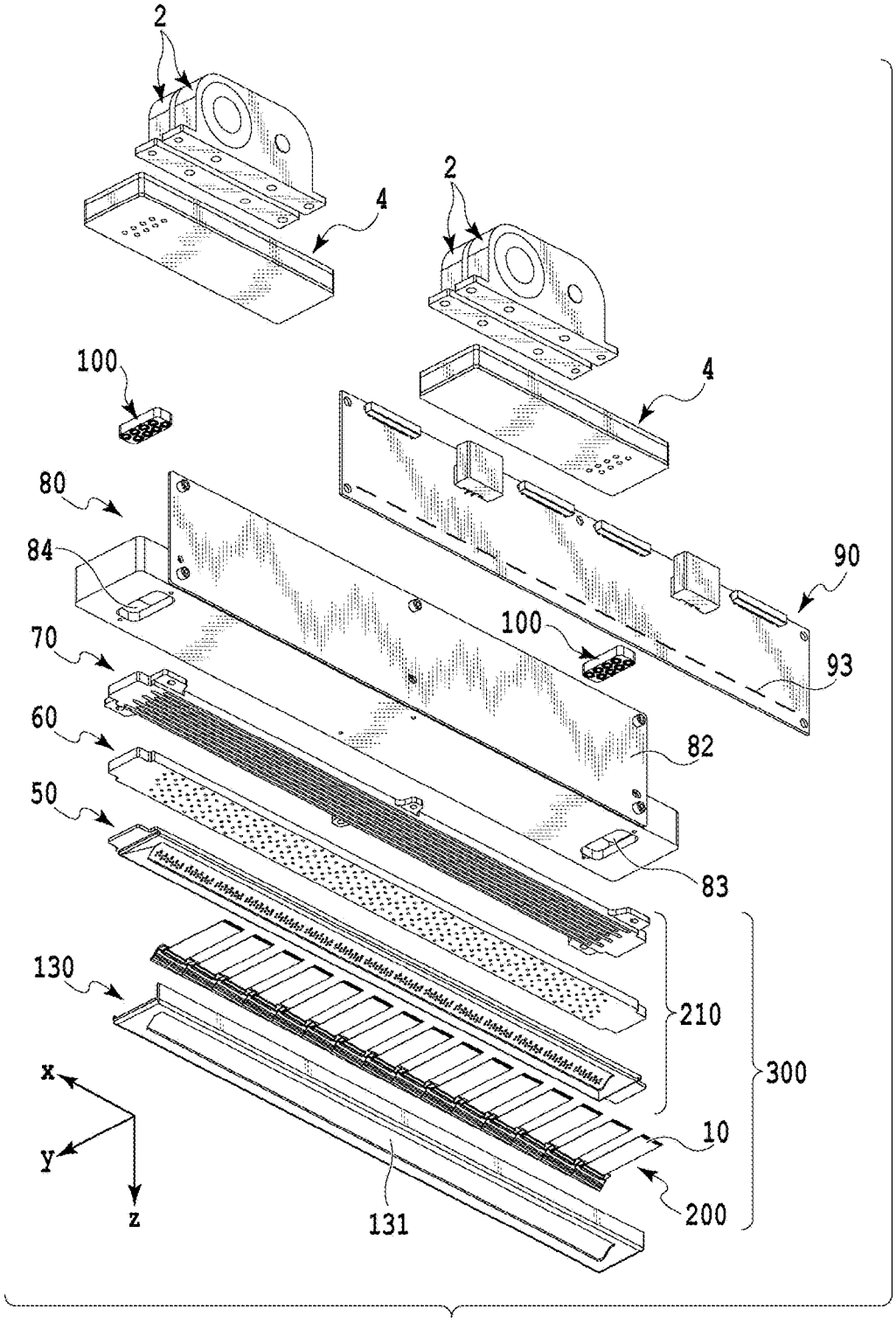
FIG. 4 is an exploded perspective view of the liquid ejecting head.

FIG. 4 is an exploded perspective view of the liquid ejecting head 3. The liquid ejecting head 3 is formed by attaching the liquid ejecting unit 300 to a housing 80 for ensuring the rigidity of the head from the +z direction, and then attaching the liquid supply units 4 and the negative pressure control units 2 in this order to the housing 80 from the −z direction. The electric wiring board 90 is secured to the housing 80 by screws from the −y direction together with an electric wiring board supporting member 82. In the liquid ejecting unit 300, a passage member 210 including three layers, an ejecting module 200 including the 15 printing element substrates 10, and a cover member 130 covering the outer edges of the passage member 210 and the ejecting module 200 are stacked in the z direction.

The negative pressure control units 2 are prepared for the four ink colors, respectively. In each negative pressure control unit 2, the negative pressure control unit H and the negative pressure control unit L described with reference to FIG. 2 are disposed in parallel in the x direction. The negative pressure control units 2 will be described later in detail.

In the present embodiment, two liquid supply units 4 are provided separately in the x direction. Each liquid supply unit 4 is associated with negative pressure control units 2 corresponding to two colors. In other words, one liquid supply unit 4 is equipped with outlet connection portions 111*a* and 111*b* and inlet connection portions 112 corresponding to two colors and filters 221 corresponding to two colors shown in FIG. 2.

The housing 80 has the function of correcting warpage of the liquid ejecting unit 300 with high accuracy and securing positional accuracy of the printing element substrates 10. It is therefore desirable that the housing 80 has rigidity sufficient for this purpose. As a material, metal such as SUS or aluminum or ceramic such as alumina is desirable. The bottom of the housing 80 is equipped with openings 83 and 84 into that joint rubbers 100 are inserted. Liquid flows between the liquid supply units 4 and the liquid ejecting unit 300 through the joint rubbers 100.

The ejecting module 200 including the 15 printing element substrates 10 is configured to eject ink as droplets. The passage member 210 is configured to guide liquid supplied from the liquid supply units 4 to each printing element substrate 10 and further to each nozzle. The passage member 210 and the ejecting module 200 will be described later in detail.

The cover member 130 has an elongated opening 131 for exposing ejection port surfaces of the printing element substrates 10. A frame portion around the opening 131 is in contact with a rubber cap member at the time of protection of the ejection port surface of the liquid ejecting head 3 or suction recovery processing. It is possible to bring about intimate contact with the cap member to improve the effects on the protection of the ejection port surfaces and the recovery processing by applying an adhesive, a sealing material, and a filling material to the inner surface of the frame portion and then attaching the surface to the ejecting module 200 in the manufacturing process of the liquid ejecting head 3.

Figure 5A:
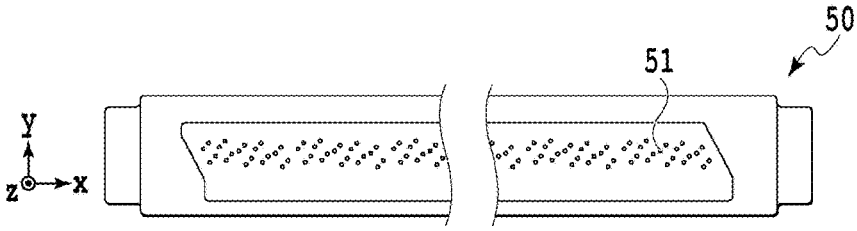
FIGS. 5A to 5F are illustrations for explaining the detailed configuration of a passage member.
Figure 5B:
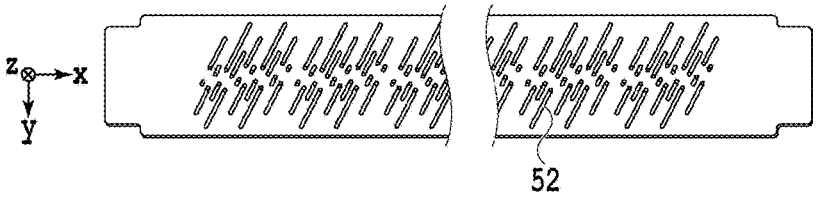
Figure 5C:
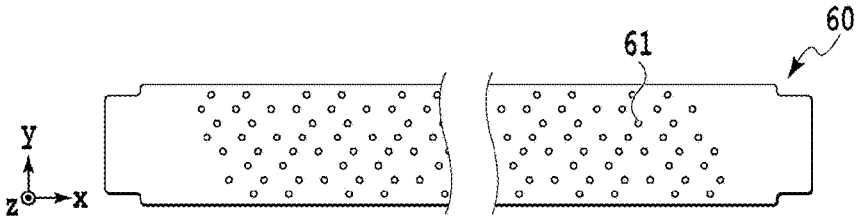
Figure 5D:
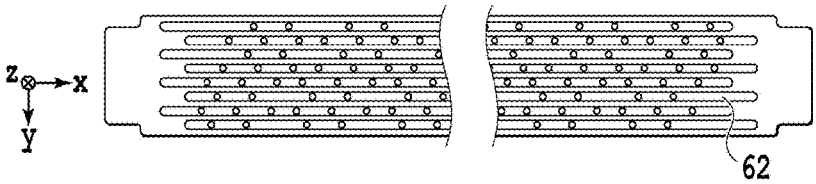
Figure 5E:
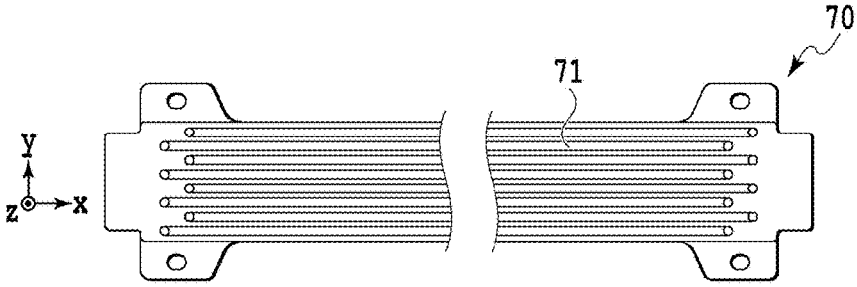
Figure 5F:
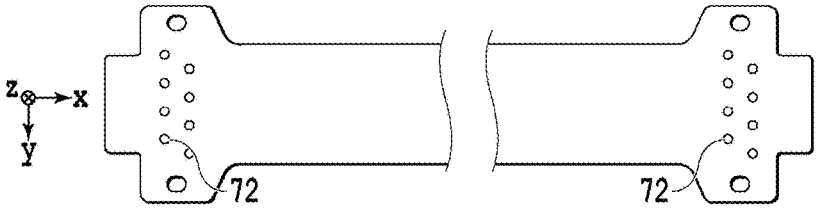

FIGS. 5A to 5F are illustrations for explaining the detailed configuration of the passage member 210. FIGS. 5A and 5B show both sides of a first passage member 50, FIGS. 5C and 5D show both sides of a second passage member 60, and FIGS. 5E and 5F show both sides of a third passage member 70. FIG. 5A shows a surface in contact with the ejecting module 200, and FIG. 5F shows a surface in contact with the liquid supply units 4. A surface of the first passage member 50 shown in FIG. 5B is in contact with a surface of the second passage member 60 shown in FIG. 5C, and a surface of the second passage member 60 shown in FIG. 5D is in contact with a surface of the third passage member 70 shown in FIG. 5E.

These passage members realize a passage configuration for guiding ink supplied from the liquid supply units 4 to each printing element substrate 10 of the ejecting module 200, and a passage configuration for returning ink that has not been consumed in each printing element substrate 10 to the liquid supply units 4. The passage member 210 is secured to the bottom surface of the housing 80 by screws and is thereby prevented from being warped or deformed.

On the surface of the third passage member 70 (FIG. 5F) in contact with the liquid supply unit 4, communication ports 72 are formed in positions corresponding to the inlet ports 301*a* and 301*b* and outlet ports 302*a* and 301*b* of the liquid supply units 4 described with reference to FIG. 2. The communication ports 72 penetrate toward the back surface (FIG. 5E) on that common passage grooves 71 extending in the x direction are formed. In the figure, four of the eight common passage grooves 71 are connected to the inlet ports for the respective ink colors, and the remaining four are connected to the outlet ports for the respective ink colors. With the above-described configuration, ink supplied from the communication ports 72 serving as inlet ports flows in the x direction along the common passage grooves 71 on the back surface.

On the surface of the second passage member 60 (FIG. 5D) in contact with the surface of the third passage member 70 shown in FIG. 5E, common passage grooves 62 extending in the x direction are formed in positions corresponding to the common passage grooves 71 formed on the third passage member 70. In each common passage groove 62, communication ports 61 penetrating toward the back surface (FIG. 5C) are formed in several positions in the x direction. With the above-described configuration, part of ink flowing along the common passage grooves 71 and 62 moves to the back surface of the second passage member 60 (FIG. 5C).

On the surface of the first passage member 50 (FIG. 5B) in contact with the surface of the second passage member shown in FIG. 5C, individual passage grooves 52 for guiding ink from the communication ports 61 formed on the second passage member 60 to the positions of nozzle arrays corresponding to the respective ink colors are formed. On the side of each individual passage groove 52 opposite to the communication ports 61, communication ports 51 penetrating toward the back surface (FIG. 5A) are formed. With the above-described configuration, ink flowing from the communication ports 61 proceeds along the individual passage grooves 52, moves to the surface of the first passage member (FIG. 5A) facing the ejecting module 200 through the communication ports 51, and is supplied to the ejecting module 200. On the other hand, ink that has not been consumed in the ejecting module 200 returns to the communication ports 72 shown in FIG. 5F through the above passages in the opposite direction and then flows into the liquid supply unit 4.

It is desirable that each of the first passage member 50, the second passage member 60, and the third passage member 70 is formed of a material having sufficient corrosion resistance against liquid (ink) and having a low linear expansion coefficient. As a material, for example, a composite material obtained by adding an inorganic filler such as fiber or fine silica particles to a base material such as alumina or a resin material, in particular a liquid crystal polymer (LCP), polyphenyl sulfide (PPS), or polysulfone (PSF) may be preferably used. The passage member 210 may be formed by causing the first passage member 50, the second passage member 60, and the third passage member 70 to adhere to each other or, in the case of using a resin composite material as a material, formed by bonding these members by welding.

Figure 6:
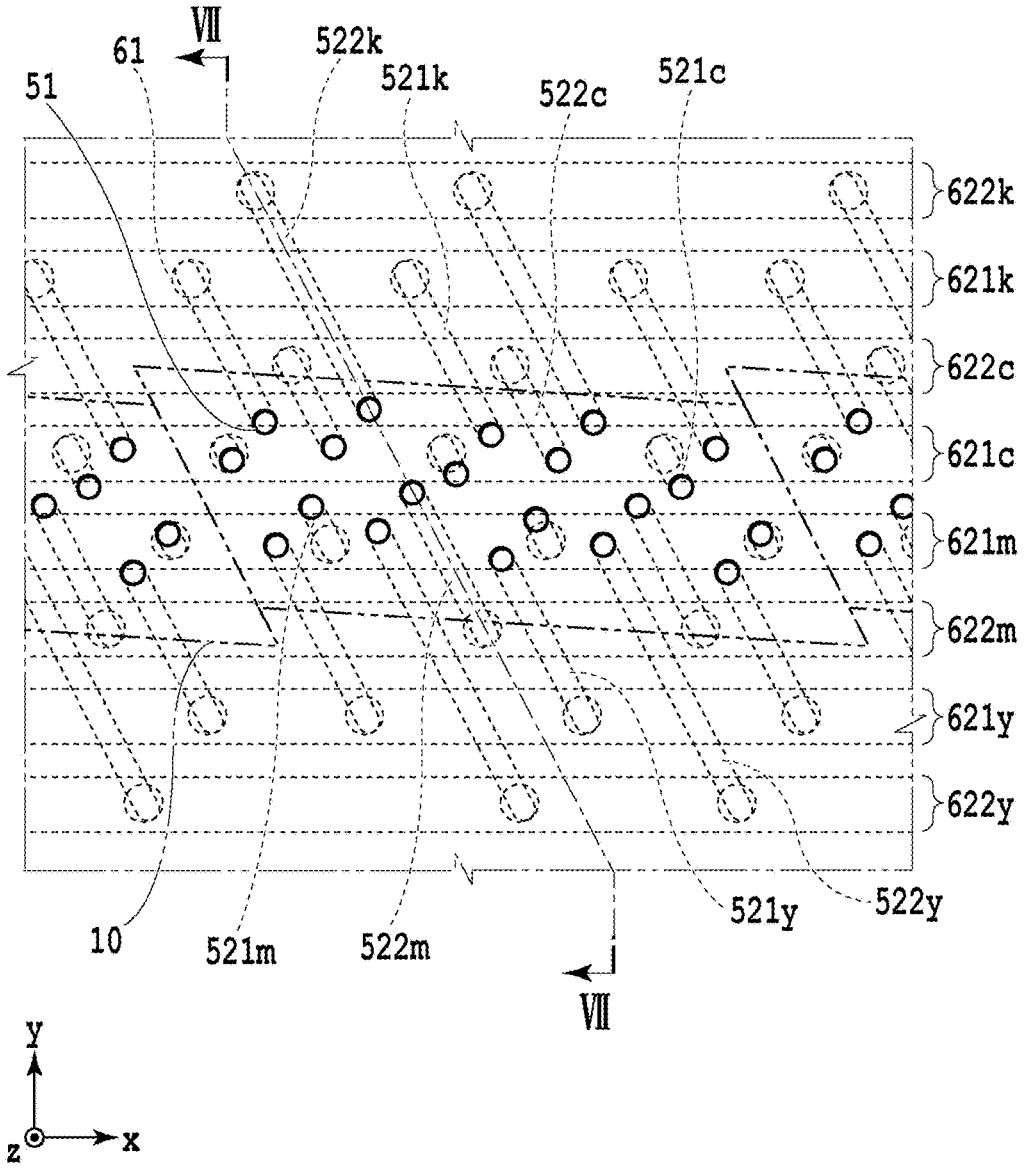
FIG. 6 is a transparent view of the passage member.

FIG. 6 is a transparent view of the first passage member 50, the second passage member 60, and the third passage member 70 in the case of viewing the passage member 210 from the −z direction. In the figure, of the eight common passage grooves 62 (71) shown in FIGS. 5D and 5E, passage grooves used for ink supply are denoted by 621*k*, 621*c*, 621*m*, and 621*y* in accordance with the respective ink colors, and passage grooves used for ink collection are denoted by 622*k*, 622*c*, 622*m*, and 622*y* in accordance with the respective ink colors. Further, of the individual passage grooves 52 shown in FIG. 5B, passage grooves used for ink supply are denoted by 521*k*, 521*c*, 521*m*, and 521*y* and passage grooves used for ink collection are denoted by 522*k*, 522*c*, 522*m*, and 522*y*. In this manner, in the communication ports 72, the common passage grooves 71 and 62, the communication ports 61, the individual passage grooves 52, and the communication ports 51, inlet passages and outlet passages are provided for each ink color.

Figure 7:
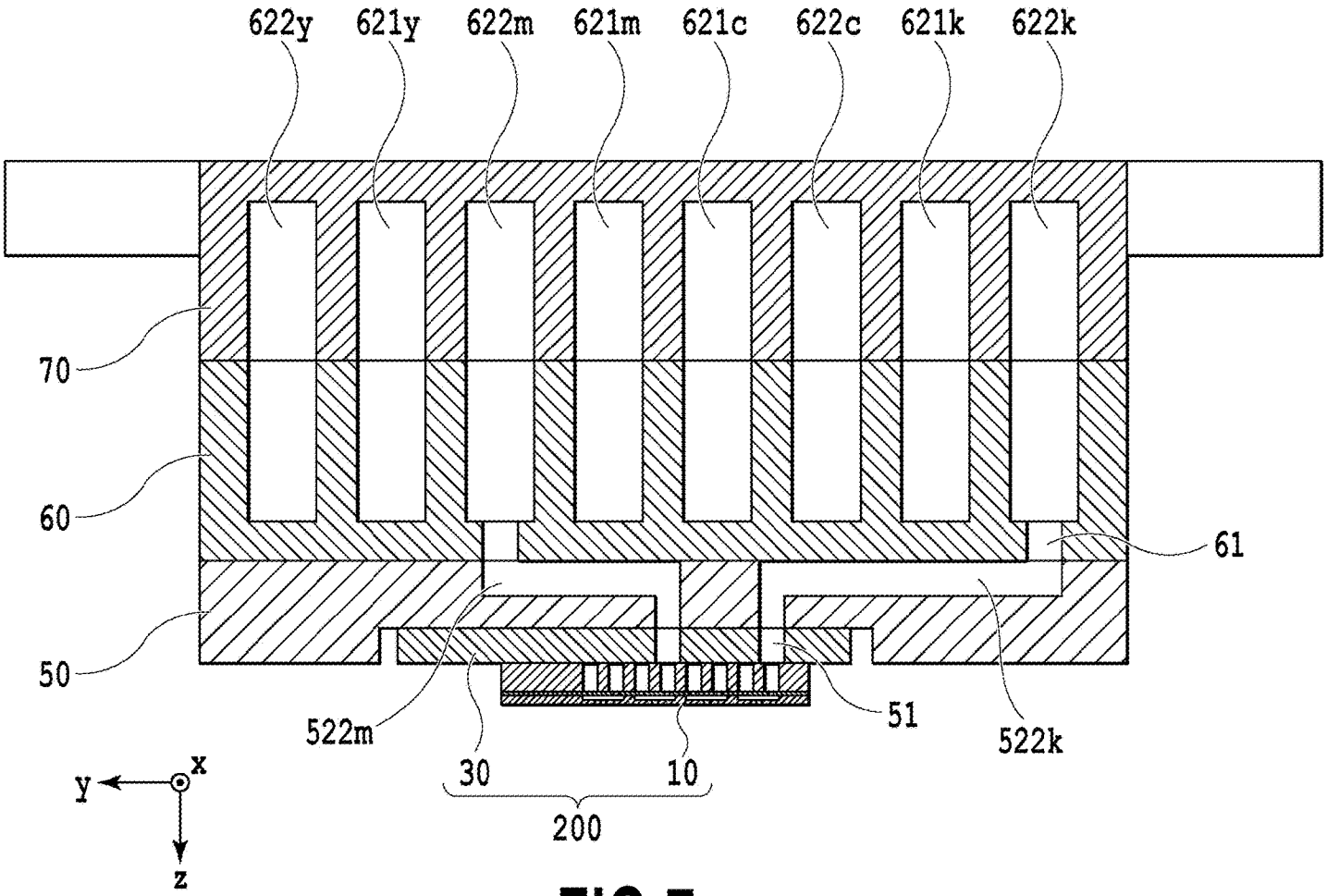
FIG. 7 is a cross-sectional view of the passage member.

FIG. 7 is a cross-sectional view along VII-VII of FIG. 6. The common supply passages 621*k*, 621*c*, 621*m*, and 621*y* for ink supply and the common collection passages 622*k*, 622*c*, 622*m*, and 622*y* for ink collection are formed by superimposing the third passage member 70 and the second passage member 60. The common collection passage 622*k* for collecting black ink (K) and the common collection passage 622*m* for collecting magenta ink (M) are connected to the individual collection passages 522*k* and 522*m* for ink collection formed on the first passage member 50, respectively. FIG. 7 also shows a cross section of the common supply passages 211 and the common collection passages 212 in the printing element substrates 10 described with reference to FIG. 2. The individual collection passage 522*k* for black ink (K) is connected to the common collection passage 212 for black ink (K) and the individual collection passage 522*m* for magenta ink (M) is connected to the common collection passage 212 for magenta ink (M).

With the above-described configuration, in the liquid ejecting unit 300 of the present embodiment, ink flows in the order of the common supply passages 621, the individual supply passages 521, the printing element substrates 10, the individual collection passages 522, and the common collection passages 622. As a result, the ink circulation described with reference to FIG. 2 can be maintained without any interruption. It should be noted that the order of the passage grooves for black, cyan, magenta, and yellow in the y direction shown in FIGS. 6 and 7 is only an example and the passage grooves may be disposed in different orders.

Figure 8A:
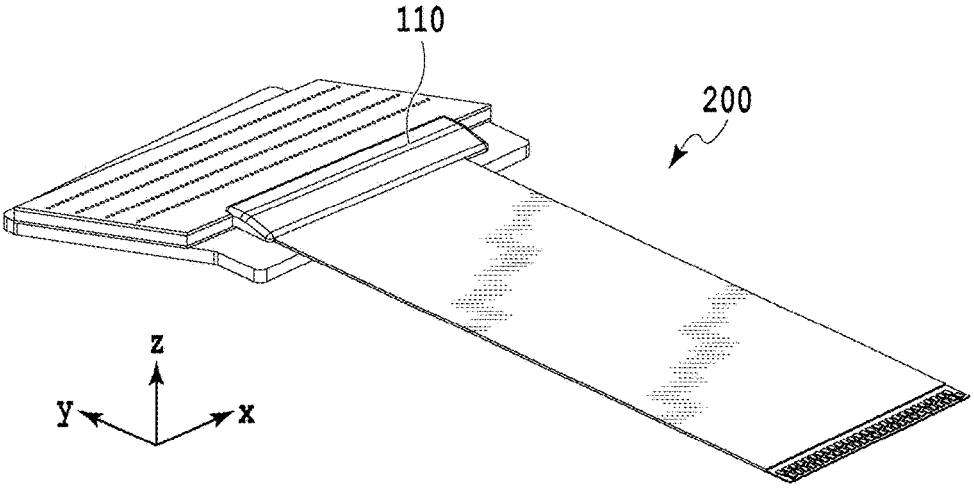
FIGS. 8A and 8B are a perspective view and an exploded view of an ejecting module, respectively.
Figure 8B:
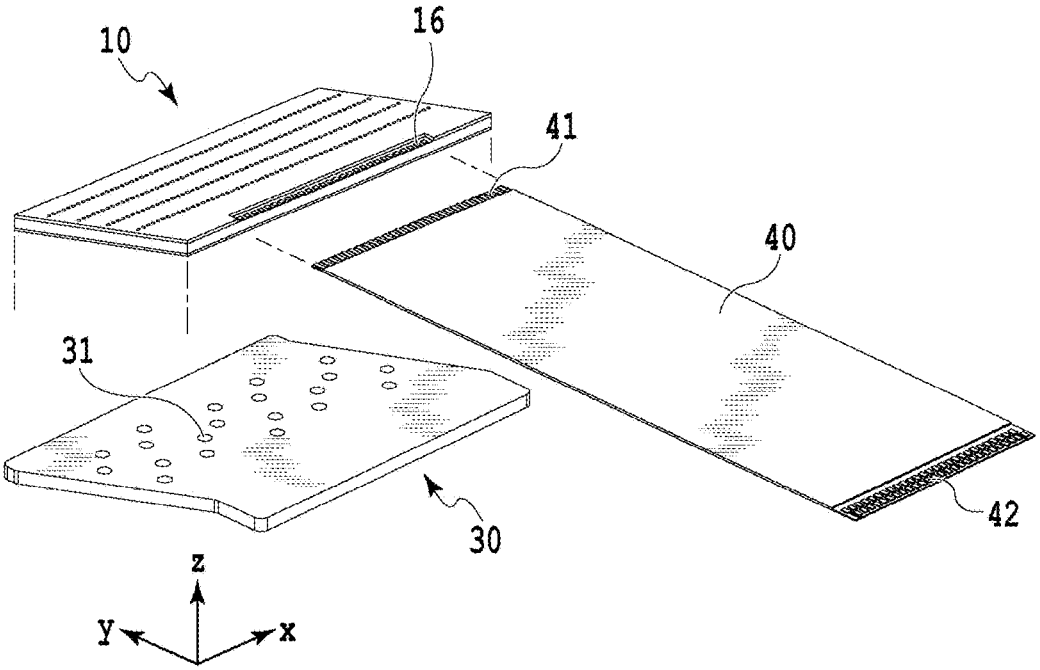

FIGS. 8A and 8B are a perspective view and an exploded view of the ejecting module 200, respectively. The ejecting module 200 is formed by causing the printing element substrate 10 to adhere to the supporting member 30, electrically connecting a terminal 16 of the printing element substrate 10 to a terminal 41 of the flexible wiring substrate 40 by wire bonding, and sealing the wire-bonded portion with a sealing material 110. In the flexible wiring substrate 40, a terminal 42 on the opposite side of the portion connected to the printing element substrate 10 is electrically connected to a connection terminal 93 of the electric wiring board 90 (see FIGS. 3A and 4). In the supporting member 30, liquid communication ports 31 for connecting with the common supply passages 211 and the common collection passages 212 described with reference to FIG. 2 are formed in positions corresponding to the communication ports 51 of the first passage member 50. The supporting member 30 serves not only as a member supporting the printing element substrate 10 but also as a passage member located between the printing element substrate 10 and the passage member 210. For this reason, it is desirable that the supporting member 30 has high flatness and sufficiently high reliability while being bonded to the printing element substrate 10. As a material, for example, alumina or a resin material is desirable.

Figure 9A:
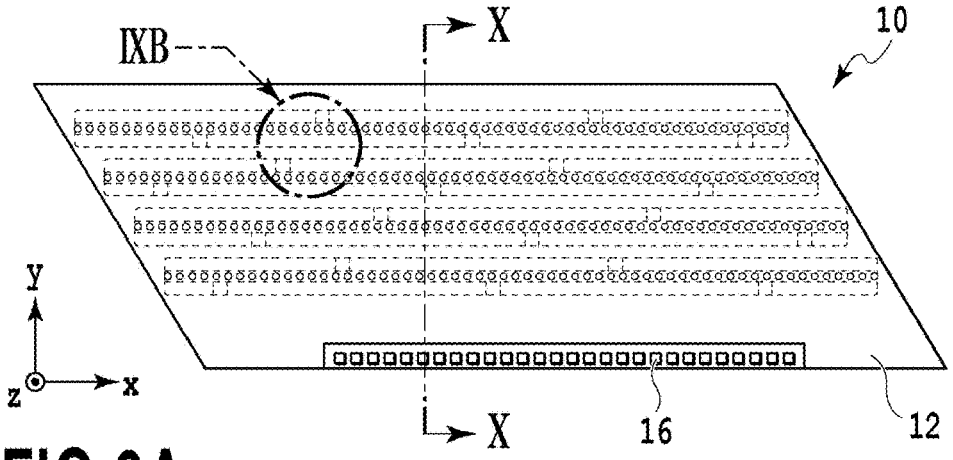
FIGS. 9A to 9C are illustrations for explaining the structure of a printing element substrate.
Figure 9B:
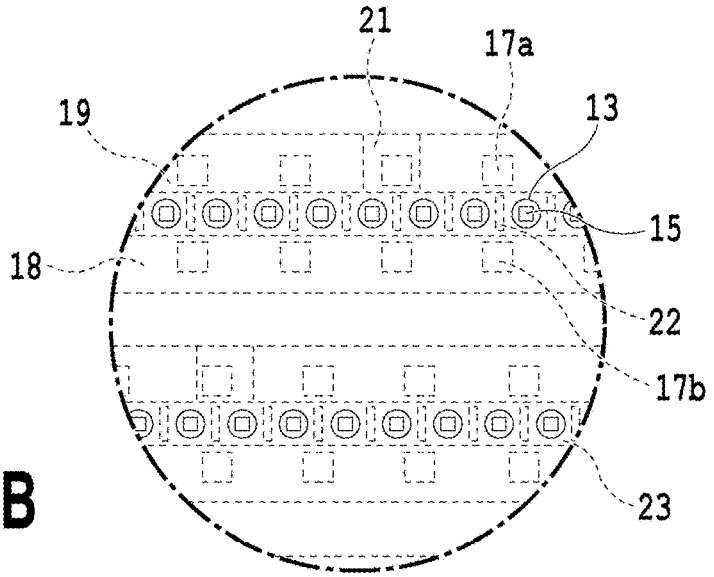
Figure 9C:
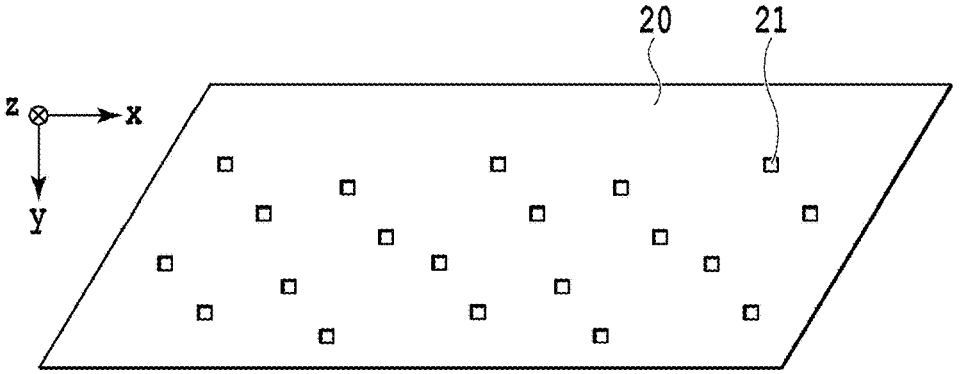
Figure 10:
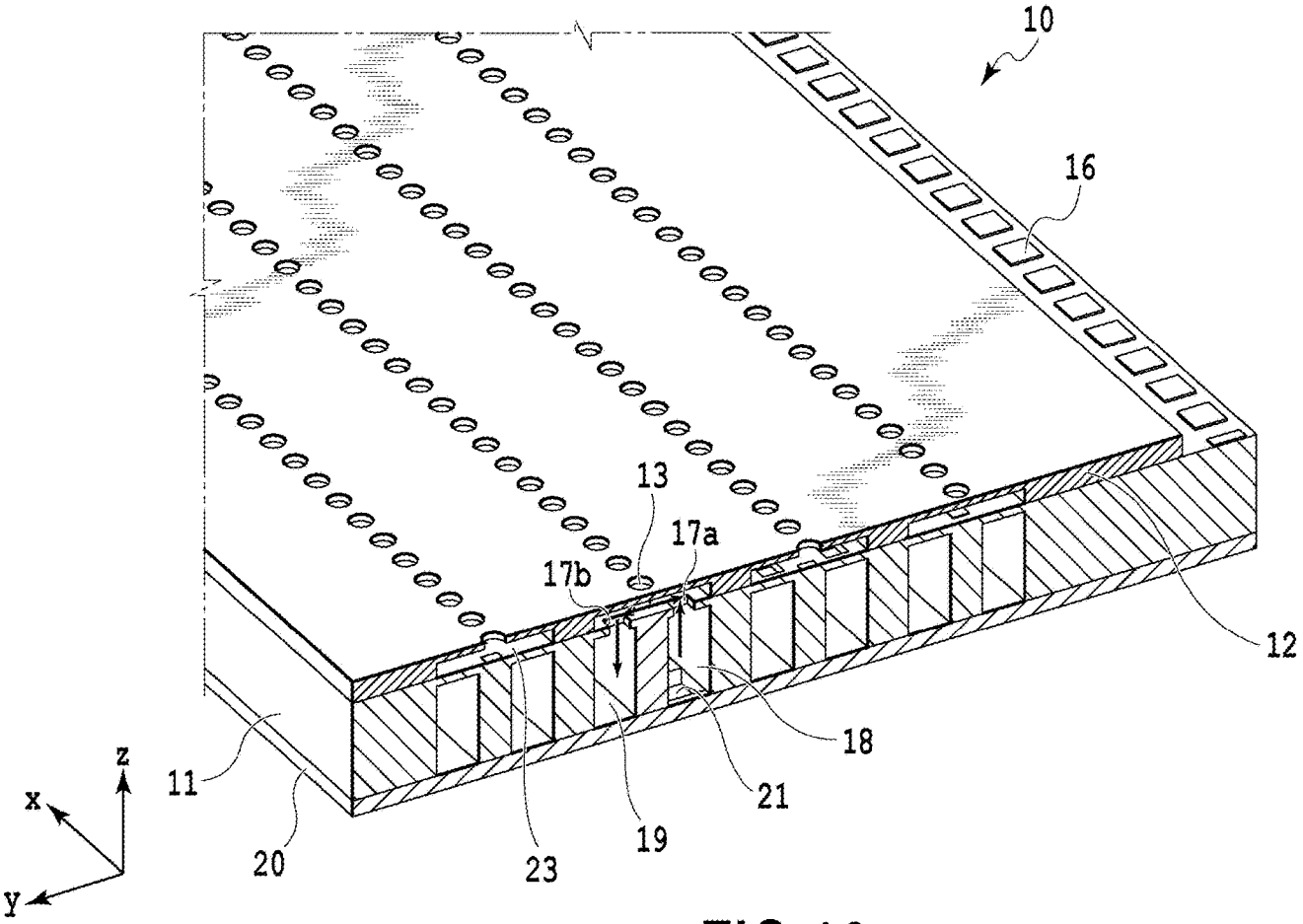
FIG. 10 is an illustration for explaining the structure of the printing element substrate.

FIGS. 9A to 9C and 10 are illustrations for explaining the structure of the printing element substrate 10. FIG. 9A is a top view of the printing element substrate 10, FIG. 9B is an enlarged view of an area IXB shown in FIG. 9A, and FIG. 9C is a back view of the printing element substrate 10. FIG. 10 is a cross-sectional view along X-X of FIG. 9A. As shown in FIG. 10, the printing element substrate 10 mainly includes an ejection port forming member 12, a substrate 11, and a cover member 20 that are stacked in the z direction.

As shown in the top view of FIG. 9A, on one ejection port forming member 12 (i.e., one printing element substrate 10), ejection port arrays each include ejection ports 13, that eject ink of the same color and are arrayed in the x direction, are disposed in parallel in the y direction for the respective colors. A terminal 16 to be bonded to the flexible wiring substrate 40 is formed at the end of the printing element substrate 10. The shape of the printing element substrate 10 of the present embodiment is a parallelogram, and the ejecting module 200 includes an array of 15 printing element substrates 10 in the x direction.

FIG. 9B is an enlarged view of the area IXB shown in FIG. 9A. In the liquid ejecting head of the present embodiment, one printing element (i.e., one nozzle) includes an electrothermal transducer 15, a pressure chamber 23, and an ejection port 13. The pressure chamber 23 is formed by two partition walls 22 arranged in the x direction. The pressure chamber 23 includes an element that generates energy used for ejecting liquid (in this case, the electrothermal transducer 15). The electrothermal transducer 15 is electrically connected to the terminal 16 and is subjected to drive control of a control circuit of the apparatus via the electric wiring board 90 and the flexible wiring substrate 40. With the above-described configuration, if a voltage pulse is applied to the electrothermal transducer 15 in accordance with ejection data, film boiling occurs in ink supplied to the pressure chamber 23, and the growth energy of the bubbles causes the ink to be ejected through the ejection port 13 opposed to the electrothermal transducer 15.

On both sides of each ejection port array in the y direction, a liquid supply passage 18 connected to the common supply passage 211 to supply ink to the pressure chamber 23 and a liquid collection passage 19 connected to the common collection passage 212 to collect ink from the pressure chamber 23 extend in the x direction. As also shown in the cross-sectional view of FIG. 10, a supply port 17*a* and a collection port 17*b* each communicating with the pressure chamber 23 are formed in the liquid supply passage and the liquid collection passage 19, respectively. Liquid inside the pressure chamber 23 can be circulated between the pressure chamber 23 and the outside of the pressure chamber 23 through the supply ports 17*a* and the collection ports 17*b*.

Further, as also shown in FIG. 9C, on the cover member 20 provided on the side in contact with the first passage member 50, a plurality of openings 21 are formed in positions corresponding to the communication openings 51 of the first passage member 50. The openings 21 communicate with the liquid supply passages 18 and the liquid collection passages 19 in the printing element substrate 10, respectively. In the cover member 20, sufficient corrosion resistance against liquid (ink) is required. Further, it is also required that the openings 21 be laid out with high accuracy from the viewpoint of preventing mixed colors. For this reason, for example, it is desirable to form the openings 21 through photolithography using a photosensitive resin material or a silicon plate.

With the above-described configuration, in the printing element substrate 10, ink flows in the order of the openings 21, the liquid supply passages 18, the supply ports 17*a*, the pressure chambers 23, the collection ports 17*b*, the liquid collection passages 19, and the openings 21. If the electrothermal transducer 15 is driven while ink flows through the pressure chamber 23, part of the ink is ejected from the ejection ports 13. At this time, the ink stably flows through the pressure chamber 23 regardless of ejection frequency. Accordingly, even if thickened ink, bubbles, foreign matters, and the like are mixed with the ink, they are guided (discharged) to the liquid collection passages 19 without staying in a particular position.

Figure 11:
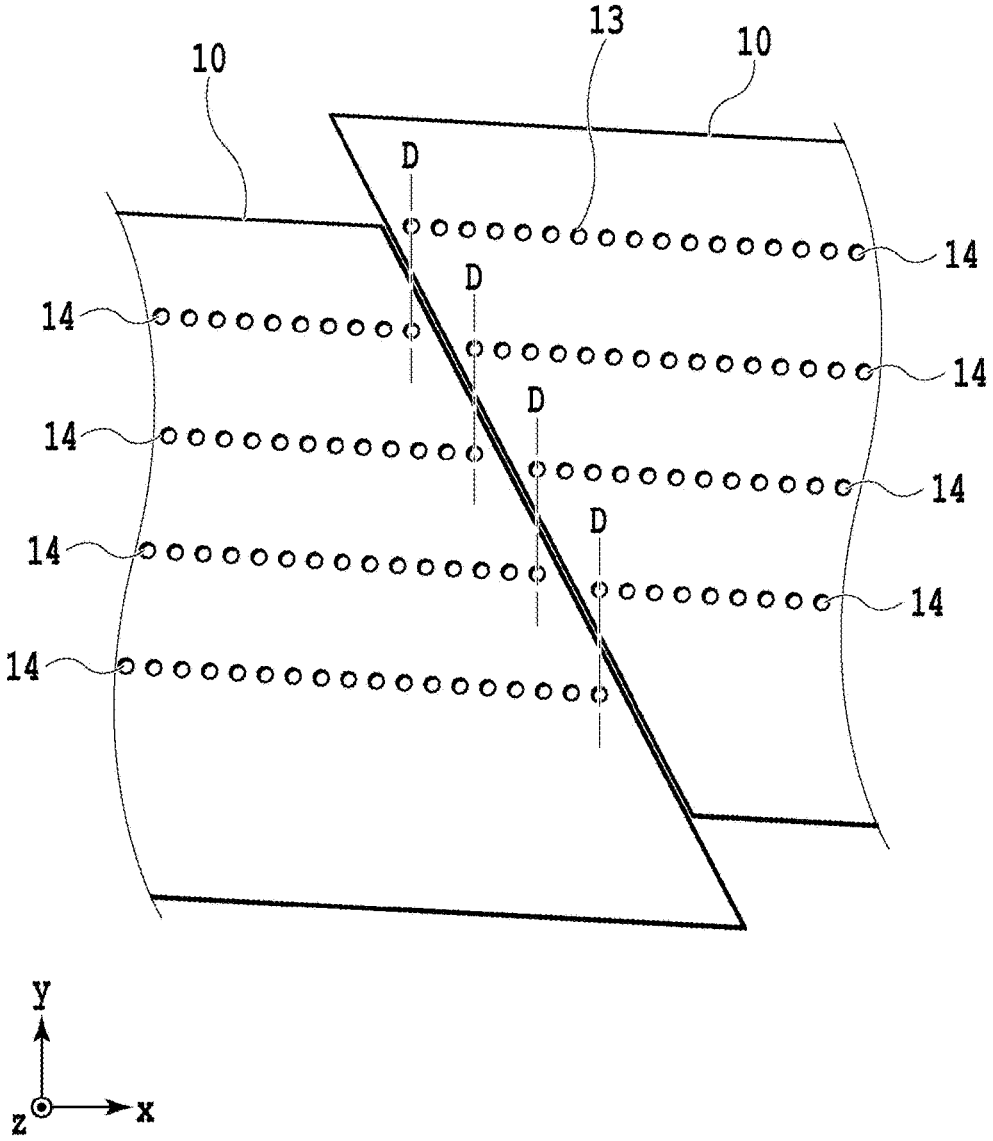
FIG. 11 is an illustration of a state of connection between printing element substrates.

FIG. 11 is an illustration of a state of connection between the printing element substrates 10. As described above with reference to FIG. 9A, the shape of the printing element substrate 10 of the present embodiment is a parallelogram. Four ejection port arrays 14 corresponding to the four ink colors are formed by continuously disposing the printing element substrates 10 in the x direction with their sides in contact with each other. At this time, two printing element substrates 10 are connected to each other such that at least one ejection port 13 located at the extreme end of one of the printing element substrates 10 is laid out in the same position in the x direction as an ejection port 13 located at the extreme end of the other of the printing element substrates 10. In other words, the tilt angle of the parallelogram is designed so as to make the above layout. In the figure, two ejection ports 13 on a line D are laid out in the same position in the x direction.

With the above-described configuration, even if two printing element substrates 10 are slightly misaligned and connected to each other in the manufacturing process of the liquid ejecting head, an image in a position corresponding to the connected portion can be printed with the cooperation of ejection ports included in the overlapped area. As a result, black streaks or missing of an image printed on a sheet caused by the misalignment can be rendered less noticeable. In the above example, the shape of the principal plane of the printing element substrate 10 is a parallelogram, but the present invention is not limited to this example. For instance, a printing element substrate having a shape of a rectangle, a trapezoid, or the like may be used.

Next, the negative pressure control unit 2 used in the present embodiment will be described in detail. As described above with reference to FIG. 2, the negative pressure control unit 2 of the present embodiment has the negative pressure control unit H that allows ink to flow at a relatively high fluid pressure and the negative pressure control unit L that allows ink to flow at a relatively low fluid pressure. The shape of the negative pressure control unit 2 shown in FIGS. 1 and 3B is obtained by parallelly disposing these two units, that are equal in outside shape, back to back in the x direction and then securing the units by screws.

The negative pressure control unit 2 of the present embodiment has a structure generally called a "pressure reduction regulator," and regulates a change in pressure loss caused by a change in flow rate of liquid by using a valve, spring members and the like to stabilize fluid pressure downstream from the negative pressure control unit 2. At this time, a fluid pressure value can be regulated within a predetermined range by varying the urging force of the spring members and the size of a pressure receiving plate, and the negative pressure control unit H and negative pressure control unit L of the present embodiment are different from each other only in the above points and have the same basic configuration. Therefore, only the negative pressure control unit H for high fluid pressure will be described below.

Figure 12A:
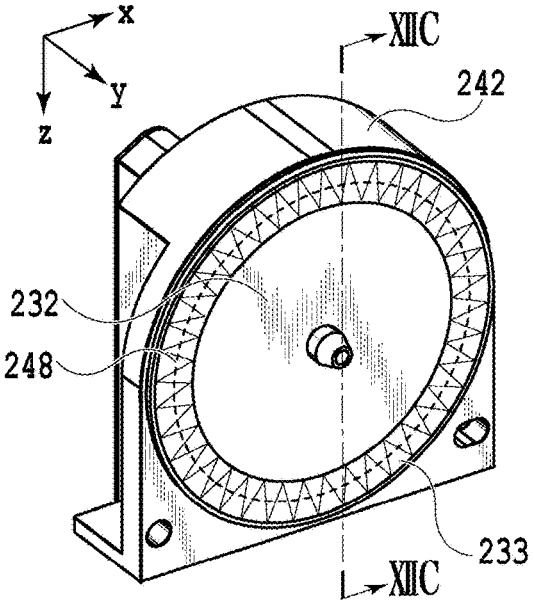
FIGS. 12A to 12C are external perspective views and a cross-sectional view of a negative pressure control unit, respectively.
Figure 12B:
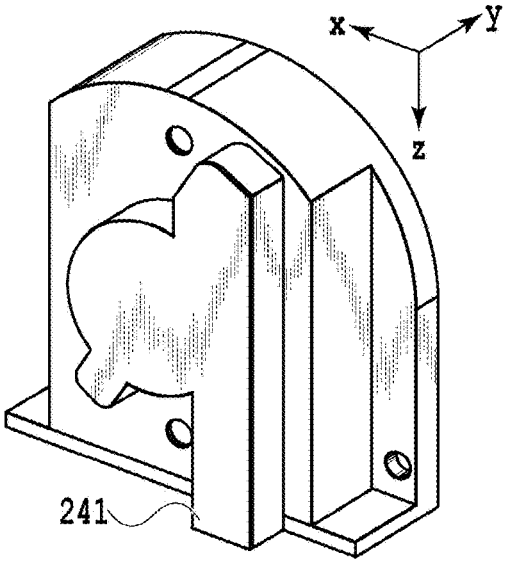
Figure 12C:
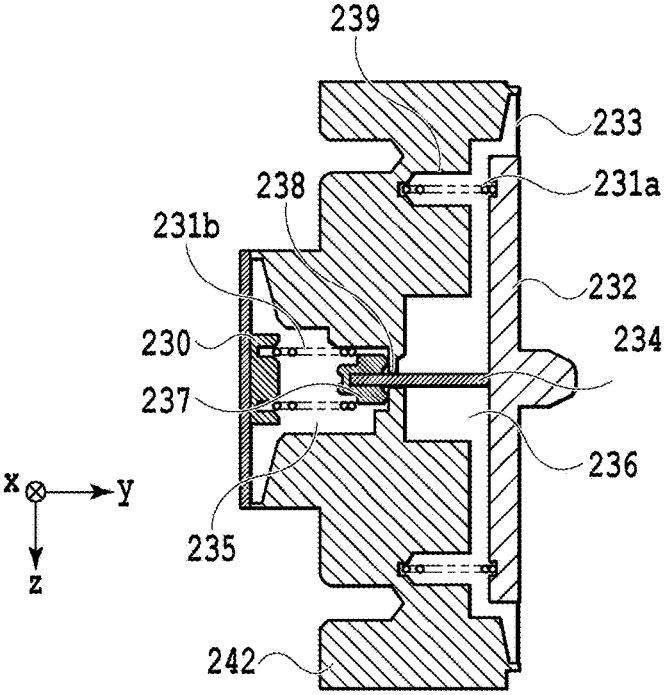
Figure 13A:
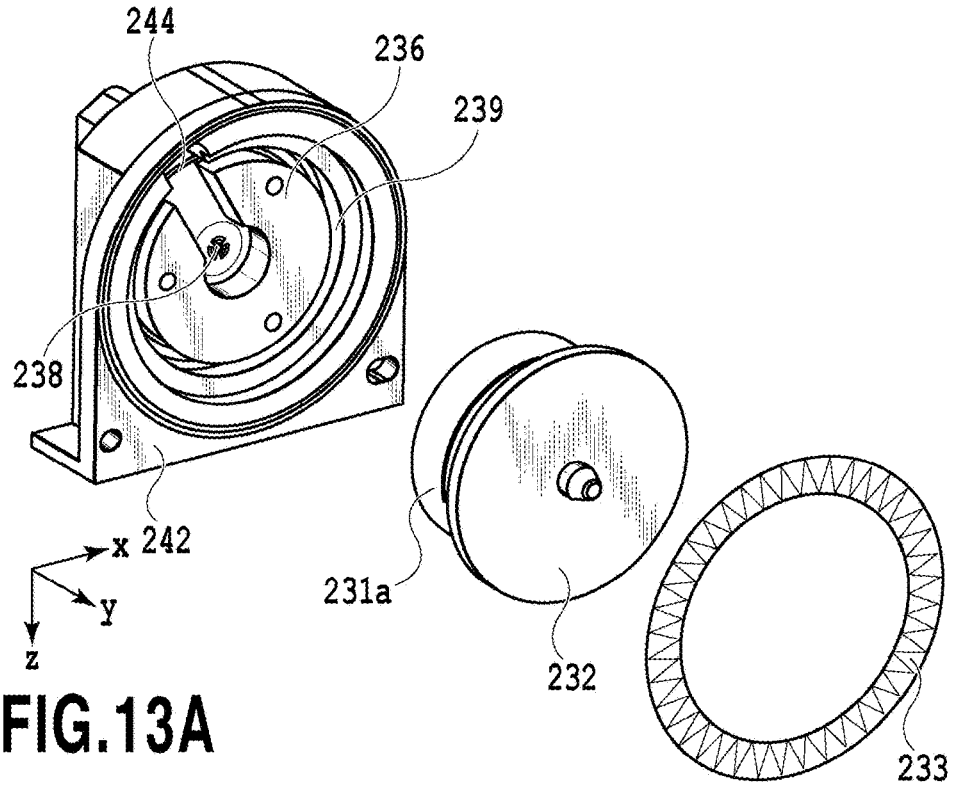
FIGS. 13A and 13B are exploded perspective views of the negative pressure control unit.
Figure 13B:
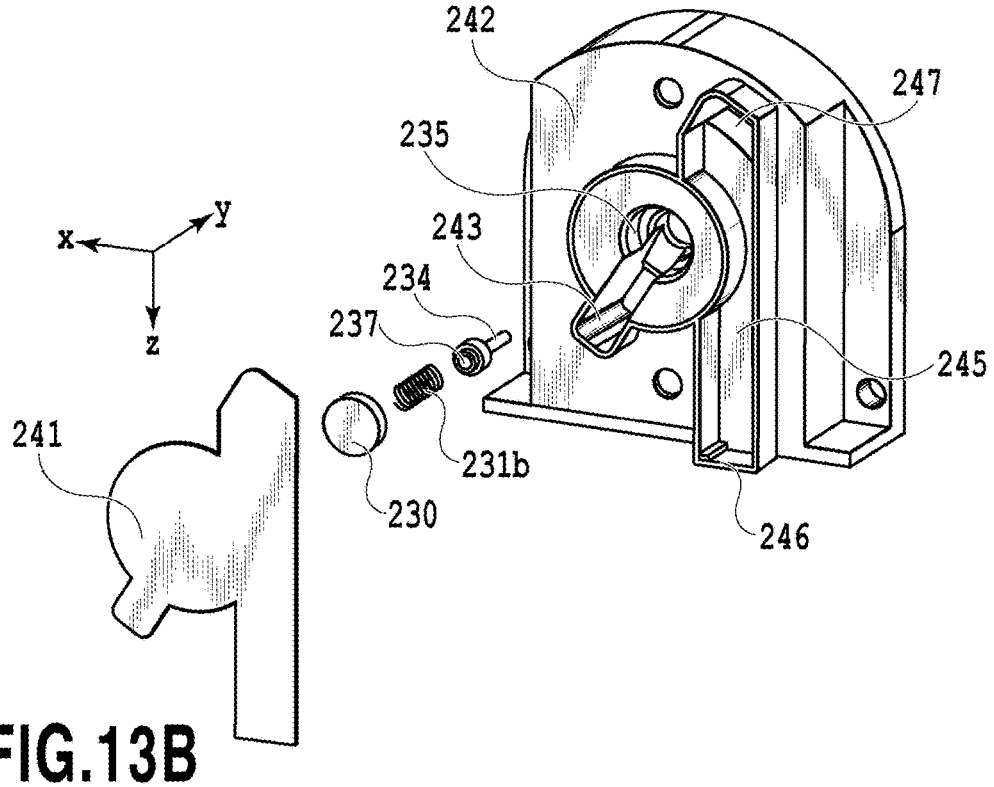

FIGS. 12A to 12C are external perspective views and a cross-sectional view of the negative pressure control unit H, respectively. FIGS. 13A and 13B are exploded perspective views of the negative pressure control unit H. As shown in FIG. 12C, the negative pressure control unit H includes a first pressure chamber 235 (hereinafter also simply referred to as a pressure chamber) and a second pressure chamber 236 (hereinafter also simply referred to as a negative pressure chamber) that are substantially horizontally connected to each other through an orifice 238. FIG. 13A is an exploded perspective view of the second pressure chamber 236 and FIG. 13B is an exploded perspective view of the first pressure chamber 235.

As shown in FIGS. 12C and 13A, the second pressure chamber 236 is formed by attaching a pressure receiving plate 232 and a flexible film 233 onto a substantially cylindrical inner wall in the −y direction in this order. The orifice 238 that can communicate with the first pressure chamber 235 is formed at the center of the inner wall on the −y side. A negative pressure chamber outlet 244 that communicates with a discharging passage 245 provided on the first pressure chamber 235 side is formed on the −z side of the orifice 238 (i.e., above the orifice 238 in the direction of gravity). A groove 239 is provided along the circumference of a circle centering around the orifice 238.

A coil-shaped urging member 231*a* is attached to the pressure receiving plate 232 from the −y direction. The second pressure chamber 236 is formed by fitting the urging member 231*a* into the groove 239, pressing the pressure receiving plate 232 in the −y direction while compressing the urging member 231*a*, and causing a ring-shaped flexible film 233 to adhere so as to cover the outer edge of the pressure receiving plate 232. Accordingly, the pressure receiving plate 232 is undergoing the urging force of the urging member 231*a* in the +y direction.

On the other hand, as shown in FIGS. 12C and 13B, the first pressure chamber 235 is formed by attaching a shaft 234, a coil-shaped urging member 231*b*, a spring holder 230, and a back film 241 onto a substantially cylindrical inner wall in the +y direction in this order. On the inner wall, an introducing passage 243 for receiving ink flowing from an introducing port 249 formed on the bottom is formed on the +z side of the orifice 238 (i.e., below the orifice 238 in the direction of gravity). The tip of the shaft 234 on the +y side is in contact with the pressure receiving plate 232 of the second pressure chamber 235 through the orifice 238. A valve 237 is attached to the tip of the shaft 234 on the −y side. The valve 237 has the function of controlling the closing and opening of the orifice 238 (the gap between the valve 237 and the orifice 238 is decreased). As a material of the valve 237, an elastic material having sufficient corrosion resistance against ink (liquid) such as a rubber or an elastomer is desirable. The tip of the urging member 231*b* on the −y side is fitted into the spring holder 230, and the tip of the urging member 231*b* on the +y side is capable of being in contact with the shaft 234. The back film 241 is not limited to a film-like member and may be, for example, a resin plate, and may be formed integrally with the spring holder 230.

With the above-described configuration, the shaft 234, the valve 237, and the pressure receiving plate 232 are integrally movable in the −y and +y directions. The pressure receiving plate 232 is urged by the urging members 231*a* and 231*b* in a direction in that the valve 237 closes the orifice 238. When the internal pressure of the second pressure chamber 236 falls below set pressure, the pressure receiving plate 232 moves in the −y direction, the valve 237 moves away from the orifice 238, and the orifice 238 is opened (the gap between the valve 237 and the orifice 238 is increased), that causes ink to flow. If the internal pressure of the second pressure chamber 236 exceeds the set pressure, the pressure receiving plate 232 moves in the +y direction, the valve 237 is brought into contact with the orifice 238, and the orifice 238 is closed.

In a state where the printing apparatus is on standby and the first high-pressure (low-pressure) circulation pump 1001 is stopped, it is desirable that the valve 237 is in contact with the orifice 238 and the orifice 238 is closed. This is because, in a case where the negative pressure regulating unit H is fluid-sealed, it is possible to generate suitable negative pressure in the liquid ejecting unit 300 downstream from the negative pressure control unit H, maintain a suitable meniscus near the ejection ports, and thereby prevent ink leakage and the like.

In the description below, the term "pressure receiving portion 248" means a portion having the function of receiving a pressure difference between the atmospheric pressure and the internal pressure of the second pressure chamber 236, and transmitting a force caused by the pressure difference to the urging members 231*a* and 231*b*, the shaft 234, and the valve 237. More specifically, the "pressure receiving portion 248" is an area shown by the dotted line in FIG. 12A including the pressure receiving plate 232 and the flexible film 233 around the pressure receiving plate 232. Since the flexible film 233 is supported by the pressure receiving plate 232 and a body 242, part of the film near the pressure receiving plate 232 mainly serves as the "pressure receiving portion 248". The effective range of pressure receiving of the flexible film 233 varies according to dimensions such as the circumference of the film and the amount of bending, tensions, and the internal pressure of the second pressure chamber 236 or the like. Thus, it is difficult to explicitly illustrate an area that serves as the pressure receiving portion.

An ink flow in the negative pressure control unit H will be described below. Ink supplied to the liquid supply unit 4 through the inlet connection portion 112 passes through the introducing port 249 and the introducing passage 243 and reaches the first pressure chamber 235 located substantially at the center in the height direction. If the valve 237 is released, ink passes through the orifice 238, proceeds to the second pressure chamber 236, and transmits the fluid pressure to the pressure receiving portion. After that, ink flows through the negative pressure chamber outlet 244 and the discharging passage 245 and then flows into the liquid supply unit 4 through the discharging port 246.

Here, it is assumed that the atmospheric pressure is P0, the internal pressure of the first pressure chamber 235 is P1, the pressure receiving area of the pressure receiving portion 248 is Sd, the pressure receiving area of the valve 237 is Sv, the spring constant of the urging members 231*a* and 231*b* is K, and the spring displacement of the urging members 231*a* and 231*b* is L. Based on the above assumption, the internal pressure P2 of the second pressure chamber 236 can be expressed by Formula 1 below in view of the balance of force on the pressure receiving plate in FIG. 12C:

$$P2=P0-(P1\times Sv+K\times L)/Sd \quad \text{(Formula 1)}$$

Further, based on the assumption that the flow resistance between the valve 237 and the orifice 238 is R and the flow rate of liquid passing through the negative pressure control unit H is Q, the internal pressure P2 of the second pressure chamber 236 can also be expressed by Formula 2 below in view of the pressure loss:

$$P2=P1-Q\times R \quad \text{(Formula 2)}$$

Figure 14:
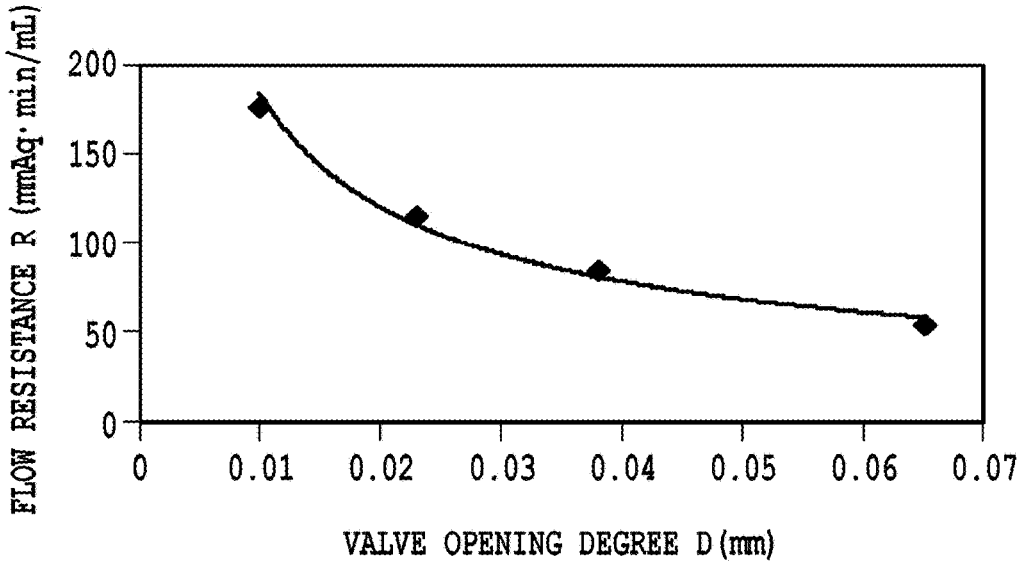
FIG. 14 is a graph showing a relationship between a flow resistance R and a valve opening degree D.

In the case of using a distance between the valve 237 and the orifice 238 as a valve opening degree D that indicates the degree of opening of the valve 237, the flow resistance R generally decreases as the valve opening degree D increases. For instance, the flow resistance R and the valve opening degree D have a relationship shown in FIG. 14.

The internal pressure P2 of the second pressure chamber 236 is stabilized by maintaining the valve opening degree D such that Formula 1 and Formula 2 are equal to each other. The above effect makes it possible to maintain P2 constant even in the case of a change in flow rate. The effect will be described below in detail.

For example, a case where the flow rate Q to the negative pressure control unit H increases is considered. In this case, since the second circulation pump 1004 (see FIG. 2) connected immediately upstream from the negative pressure control unit H has constant pressure, the flow resistance between the second circulation pump and the negative pressure control unit 2 increases in accordance with the increase in the flow rate Q, and the internal pressure P1 of the first pressure chamber 235 decreases. As a result, the internal pressure P2 of the second pressure chamber 236 temporarily increases according to Formula 1.

In a case where the flow rate Q and the internal pressure P2 of the second pressure chamber increase and the internal pressure P1 of the first pressure chamber decreases, the flow resistance R decreases according to Formula 2. The valve opening degree D thus increases according to in FIG. 14. However, as the valve opening degree D increases, the compression amount L of the urging members 231*a* and 231*b* also increases, with the result that the force in the y direction exerted by the urging members 231*a* and 231*b* on the valve 237 and the pressure receiving plate 232 increases. Consequently, the internal pressure P2 of the second pressure chamber 236 instantly decreases according to Formula 1.

In contrast, in a case where the flow rate Q to the negative pressure control unit H decreases, the reverse of the above phenomenon instantly occurs. In other words, if the above-described negative pressure control unit H is provided, the fluid pressure of ink supplied to a member located downstream from the negative pressure control unit H can be stabilized within a desired range.

According to Formula 1, the fluctuation range of P2 is equal to a value obtained by multiplying the fluctuation range of P1 by Sv/Sd. Therefore, in the present embodiment, the fluctuation range of P2 is reduced and the fluid pressure downstream from the negative pressure control unit H is stabilized within a desired range by designing Sv/Sd, that is a ratio between the pressure receiving area in the pressure receiving portion and the pressure receiving area in the valve, to be sufficiently small.

Incidentally, as described above, in a case where the flow rate inside the negative pressure control unit is large, bubbles may be produced in the second pressure chamber 236 after ink passes through the orifice 238. If such bubbles are gathered or coupled to have a large size, the bubbles may interfere with the contact between the pressure receiving portion 248 and ink and tilt the pressure receiving plate 232, that destabilizes the internal pressure of the second pressure chamber 236 and the fluid pressure therefrom. In order to prevent such a risk, in the present embodiment, the negative pressure chamber outlet 244 is provided above the orifice 238 in the vertical direction (i.e., on the +z side of the orifice 238) to facilitate removing the produced bubbles from the second pressure chamber.

Figure 15A:
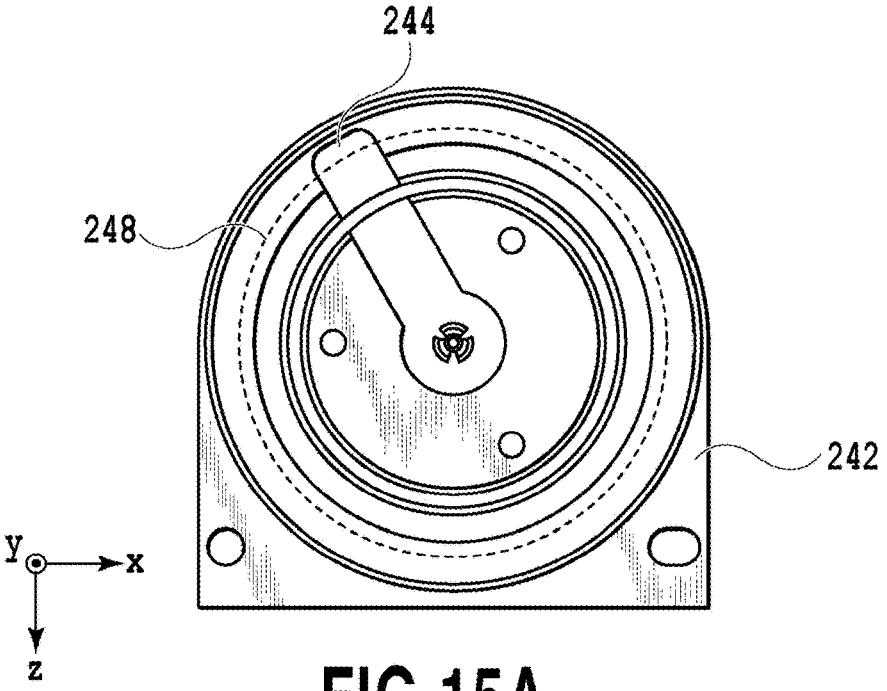
FIGS. 15A and 15B are illustrations of the front and back of the negative pressure control unit.
Figure 15B:
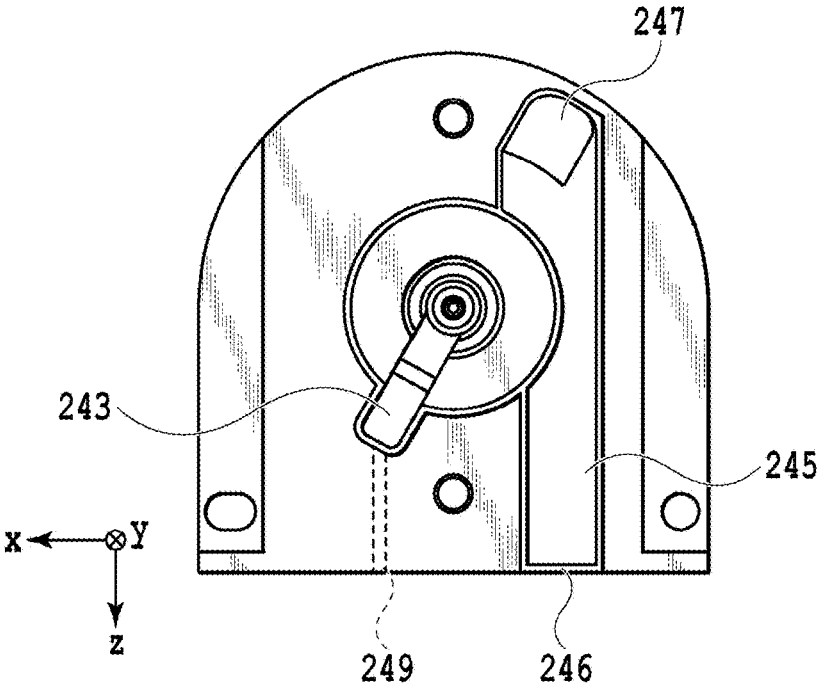

FIGS. 15A and 15B are illustrations of the front and back of the negative pressure control unit in the y direction. FIG. 15A shows the negative pressure control unit from the second pressure chamber 236 side (i.e., from the +y direction), and FIG. 15B shows the negative pressure control unit from the first pressure chamber 235 side (i.e., from the −y direction). In the second pressure chamber 236, bubbles that have moved upward from the orifice 238 in the vertical direction (i.e., in the +z direction) by their buoyancy are guided to the negative pressure chamber outlet 244 and then move to the back side (i.e., the first pressure chamber side). The negative pressure chamber outlet 244 is connected to the discharging passage 245 extending downward in the z direction (i.e., in the direction of gravity) on the back side (i.e., the first pressure chamber side). A bubble accumulation portion 247 is formed at the top of the discharging passage 245 in the z direction (i.e., in the direction of gravity). The bubble accumulation portion 247 has space above the negative pressure chamber outlet 244.

With the above-described configuration, liquid flowing from the negative pressure chamber outlet 244 and including bubbles is basically discharged from the discharging port 246 through the discharging passage 245 in accordance with the flow of the pump. Bubbles that have high buoyancy and float up against the ink flow are accumulated in the bubble accumulation portion 247. In this manner, in the present embodiment, ink from the second pressure chamber 236 is once guided to the bubble accumulation portion 247 located above in the direction of gravity and then guided to the discharging port 246 so as to be guided out of the discharging port 246 (i.e., discharged from the discharging port 246). Accordingly, even if bubbles are produced in the second pressure chamber 236, the internal pressure of the second pressure chamber 236 and the fluid pressure therefrom can be prevented from becoming unstable by the existence of the bubbles. As a result, in the liquid ejecting unit 300, it is possible to suitably control the negative pressure and maintain the stable ejecting operation even in the case of a relatively large flow rate.

At this time, in order to guide bubbles to the discharging port 246 as much as possible to discharge the bubbles therefrom, it is desirable that the average flow speed in the discharging passage 245 is greater than the average flow speed between the orifice 238 and the negative pressure chamber outlet 244 in the second pressure chamber 236. For example, a suitable flow speed can be obtained in the discharging passage 245 by setting the width of the discharging passage 245 to be greater than a length of the shortest passage between the orifice 238 and the negative pressure chamber outlet 244.

Further, in the present embodiment, the introducing port 249 and the introducing passage 243 for allowing ink to flow into the negative pressure regulating unit H and the discharging port 246 and the discharging passage 245 for allowing ink to flow from the negative pressure regulating unit H are formed on the surface on the same side of the negative pressure regulating unit H (i.e., the surface on the −y side). Accordingly, it is possible to reduce the width of the negative pressure regulating unit H in the y direction to save space in comparison with, for example, Japanese Patent No. 3606282.

In the above description, two coil-shaped urging members 231*a* and 231*b* are used as coupled springs, but the number of urging members is not limited to this. One spring or three or more coupled springs may be used as long as a desired negative pressure value can be obtained. Further, a leaf spring may be used instead of the coil spring.

In the above description, the pressure receiving portion includes the pressure receiving plate 232 and the flexible film 233, but another configuration may be used as long as the valve 237 can be horizontally moved according to the internal pressure of the second pressure chamber 236. For example, the flexible film 233 may be directly connected to the shaft 234 without interposing the pressure receiving plate 232 therebetween. Alternatively, an elastic film-like member (i.e., a diaphragm) may be used instead of the pressure receiving plate and the film. In this case, the diaphragm may have the function of urging the valve 237 as well as the function of the pressure receiving portion.

In the above embodiment, an inkjet printing apparatus having the electrothermal transducer is used as the liquid ejecting apparatus of the present invention. However, the present invention is not limited to such an embodiment. A liquid ejecting head using a piezo system for liquid ejection may also be used.

Further, since the negative pressure regulating unit of the present invention is effective in particular in the case of a large flow rate of liquid, a full line type inkjet printing apparatus is used as an example. However, the negative pressure regulating unit of the present invention may also be applied to a serial type inkjet apparatus.

Furthermore, in the above embodiment, the circulation circuit has the negative pressure regulating unit H for maintaining high fluid pressure and the negative pressure regulating unit L for maintaining low fluid pressure as described above with reference to in FIG. 2. However, the present invention is not limited to such an embodiment. The negative pressure regulating unit of the present invention may also be applied to a system other than the circulation system. For example, if one above-described negative pressure regulating unit is provided upstream from the liquid ejecting head, the fluid pressure in the liquid ejecting head can be suitably regulated even if it is not a circulation system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-104309 filed May 25, 2016, which is hereby incorporated by reference wherein in its entirety.

What is claimed is:

1. A liquid ejecting apparatus comprising:

a liquid ejecting unit configured to eject liquid supplied from a tank; and a negative pressure regulating unit, being provided between passages connecting the tank to the liquid ejecting unit, configured to regulate fluid pressure of liquid flowing into the liquid ejecting unit, wherein the negative pressure regulating unit includes: a negative pressure chamber whose internal pressure is regulated within a predetermined range, a discharging passage for discharging liquid stored in the negative pressure chamber from the negative pressure regulating unit, a pressure chamber being able to horizontally communicate with the negative pressure chamber, and an introducing passage guiding liquid from an introducing port opened in the bottom to the pressure chamber, the discharging passage has an outlet and a bubble accumulation portion and a passage, the outlet being disposed in an upper portion of the negative pressure chamber in a direction of gravity, the bubble accumulation portion being connected to the outlet above the outlet in the direction of gravity and being constructed to accumulate bubbles discharged from the negative pressure chamber, and the passage guiding liquid flowing from the outlet to a discharging port opened in a bottom of the negative pressure regulating unit, and the discharging passage, the introducing passage and the bubble accumulation portion are provided on a side of the pressure chamber of the negative pressure regulating unit, which is different from a side of the negative pressure chamber.

2. The liquid ejecting apparatus according to claim 1 wherein the negative pressure regulating unit further includes a valve for controlling closing and opening of an orifice through which the pressure chamber and the negative pressure chamber communicate with each other, an urging member urging the valve in a direction in which the orifice is closed, and a pressure receiving portion moving in accordance with a decrease in the internal pressure of the negative pressure chamber and acting on the valve in a direction in which the orifice is opened.

3. The liquid ejecting apparatus according to claim 2, wherein the liquid ejecting unit includes a supply passage for supplying liquid to a printing element substrate and a collection passage for collecting liquid from the printing element substrate for the same type of liquid, and the negative pressure regulating unit for supplying liquid to the supply passage at a relatively high fluid pressure and the negative pressure regulating unit for supplying liquid to the collection passage at a relatively low fluid pressure are provided for each type of liquid.

4. The liquid ejecting apparatus according to claim 1, wherein an average flow speed of the liquid in the discharging passage is greater than an average flow speed from an inlet of the negative pressure chamber to the outlet of the negative pressure chamber.

5. The liquid ejecting apparatus according to claim 4, wherein the liquid ejecting unit includes supply passage for supplying liquid to a printing element substrate and a collection passage for collecting liquid from the printing element substrate for the same type of liquid, and the negative pressure regulating unit for supplying liquid to the supply passage at a relatively high fluid pressure and the negative pressure regulating unit for supplying liquid to the collection passage at a relatively low fluid pressure are provided for each type of liquid.

6. The liquid ejecting apparatus according to claim 1, wherein the liquid ejecting unit is made up of an array of a plurality of printing element substrates that eject the same type of liquid, and the negative pressure regulating unit supplies liquid to the plurality of printing element substrates in common.

7. The liquid ejecting apparatus according to claim 6, wherein the liquid ejecting unit includes a supply passage for supplying liquid to a printing element substrate and a collection passage for collecting liquid from the printing element substrate for the same type of liquid, and the negative pressure regulating unit for supplying liquid to the supply passage at a relatively high fluid pressure and the negative pressure regulating unit for supplying liquid to the collection passage at a relatively low fluid pressure are provided for each type of liquid.

8. The liquid ejecting apparatus according to claim 1, wherein the liquid ejecting unit includes a supply passage for supplying liquid to a printing element substrate and a collection passage for collecting liquid from the printing element substrate for the same type of liquid, and the negative pressure regulating unit for supplying liquid to the supply passage at a relatively high fluid pressure and the negative pressure regulating unit for supplying liquid to the collection passage at a relatively low fluid pressure are provided for each type of liquid.

9. The liquid ejecting apparatus according to claim 1, wherein the liquid ejecting unit includes a supply passage for supplying liquid to a printing element substrate and a collection passage for collecting liquid from the printing element substrate for the same type of liquid, and the negative pressure regulating unit for supplying liquid to the supply passage at a relatively high fluid pressure and the negative pressure regulating unit for supplying liquid to the collection passage at a relatively low fluid pressure are provided for each type of liquid.

10. A liquid ejecting head comprising:

a negative pressure regulating unit configured to regulate fluid pressure of liquid supplied from a tank; and a liquid ejecting unit, being connected to the negative pressure regulating unit, configured to eject liquid whose fluid pressure has been regulated, wherein the negative pressure regulating unit includes: a negative pressure chamber whose internal pressure is regulated within a predetermined range, a discharging passage for discharging liquid stored in the negative pressure chamber from the negative pressure regulating unit, a pressure chamber being able to horizontally communicate with the negative pressure chamber, and an introducing passage guiding liquid from an introducing port opened in the bottom to the pressure chamber, the discharging passage has an outlet and a bubble accumulation portion and a passage, the outlet being disposed in an upper portion of the negative pressure chamber in a direction of gravity, the bubble accumulation portion being connected to the outlet above the outlet in the direction of gravity and being constructed to accumulate bubbles discharged from the negative pressure chamber, and the passage guiding liquid flowing from the outlet to a discharging port opened in a bottom of the negative pressure regulating unit, and the discharging passage, the introducing passage and the bubble accumulation portion are provided on a side of the pressure chamber of the negative pressure regulating unit, which is different from a side of the negative pressure chamber.

11. The liquid ejecting head according to claim 10, wherein the liquid ejecting unit has a pressure chamber in which an element generating energy used for ejecting liquid is provided, and liquid in the pressure chamber provided with the element is circulated between the pressure chamber provided with the element and an outside of the pressure chamber provided with the element.

12. The liquid ejecting head according to claim 11, wherein an average flow speed of the liquid in the discharging passage is greater than an average flow speed from an inlet of the negative pressure chamber to the outlet of the negative pressure chamber.

13. The liquid ejecting head according to claim 11, wherein the liquid ejecting unit is made up of an array of a plurality of printing element substrates that eject the same type of liquid, and the negative pressure regulating unit supplies liquid to the plurality of printing element substrates in common.

14. The liquid ejecting head according to claim 11, wherein the liquid ejecting unit includes a supply passage for supplying liquid to a printing element substrate and a collection passage for collecting liquid from the printing element substrate for the same type of liquid, and the negative pressure regulating unit for supplying liquid to the supply passage at a relatively high fluid pressure and the negative pressure regulating unit for supplying liquid to the collection passage at a relatively low fluid pressure are provided for each type of liquid.

15. The liquid ejecting head according to claim 10, wherein the negative pressure regulating unit further includes a valve for controlling closing and opening of an orifice through which the pressure chamber and the negative pressure chamber communicate with each other, an urging member urging the valve in a direction in which the orifice is closed, and a pressure receiving portion moving in accordance with a decrease in the internal pressure of the negative pressure chamber and acting on the valve in a direction in which the orifice is opened.

16. The liquid ejecting head according to claim 10, wherein an average flow speed of the liquid in the discharging passage is greater than an average flow speed from an inlet of the negative pressure chamber to the outlet of the negative pressure chamber.

17. The liquid ejecting head according to claim 10, wherein the liquid ejecting unit is made up of an array of a plurality of printing element substrates that eject the same type of liquid, and the negative pressure regulating unit supplies liquid to the plurality of printing element substrates in common.

18. The liquid ejecting head according to claim 10, wherein the liquid ejecting unit includes a supply passage for supplying liquid to a printing element substrate and a collection passage for collecting liquid from the printing element substrate for the same type of liquid, and the negative pressure regulating unit for supplying liquid to the supply passage at a relatively high fluid pressure and the negative pressure regulating unit for supplying liquid to the collection passage at a relatively low fluid pressure are provided for each type of liquid.

* * * * *